US008028386B2

(12) United States Patent
Rock et al.

(10) Patent No.: US 8,028,386 B2
(45) **Date of Patent: *Oct. 4, 2011**

(54) ENGINEERED FABRIC ARTICLES

(75) Inventors: Moshe Rock, Brookline, MA (US); William K. Lie, Methuen, MA (US); Charles Haryslak, Marlborough, MA (US); David Costello, Marblehead, MA (US); Jane Hunter, Manassas, VA (US)

(73) Assignee: MMI-IPCO, LLC, Lawrence, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/815,178

(22) Filed: Jun. 14, 2010

(65) Prior Publication Data

US 2010/0242148 A1 Sep. 30, 2010

Related U.S. Application Data

(63) Continuation of application No. 11/569,041, filed as application No. PCT/US2005/022479 on Jun. 23, 2005, now Pat. No. 7,743,476.

(60) Provisional application No. 60/582,674, filed on Jun. 24, 2004, provisional application No. 60/605,563, filed on Aug. 30, 2004, provisional application No. 60/626,191, filed on Nov. 9, 2004, provisional application No. 60/682,695, filed on May 19, 2005.

(51) Int. Cl.
*D06C 23/00* (2006.01)

(52) U.S. Cl. ..... 28/160; 28/159; 28/143; 28/153

(58) Field of Classification Search ..... 28/159, 28/160, 153, 161, 162, 163, 165, 170, 140, 28/143; 26/8 R, 2 R, 9; 428/85, 88, 89, 97, 428/90, 92, 87; 2/69, 243.1, 458, 108, 93, 2/115, 227, 79, 106, 158, 159, 167, 169, 2/85, 81; 66/170, 171, 191, 194; 139/391–394, 139/396; 5/482, 486

See application file for complete search history.

(56) References Cited

U.S. PATENT DOCUMENTS 436,366 A 9/1890 Levy (Continued)

FOREIGN PATENT DOCUMENTS

EP 0 629 727 A1 12/1994

(Continued)

OTHER PUBLICATIONS

International Sear Report, International Application No. PCT/US05/22479, dated Oct. 2, 2006, 2 pages.

(Continued)

*Primary Examiner* — Amy Vanatta
(74) *Attorney, Agent, or Firm* — Fish & Richardson P.C.

(57) ABSTRACT

Methods are described for forming unitary fabric elements for use in engineered thermal fabric articles, including, but not limited to, thermal fabric garments, thermal fabric home textiles, and thermal fabric upholstery covers, and for forming these engineered thermal fabric articles, having predetermined discrete regions of contrasting insulative capacity positioned about the thermal fabric article in correlation to insulative requirements of a user's body. In one implementation, loop yarn in first regions is formed to a first pile height, and loop yarn in other regions is formed to another, different, relatively greater pile height. In another implementation, loop yarn having a first shrinkage performance is formed in first regions to a predetermined loop height, and loop yarn having another, different shrinkage performance is formed in other regions to the predetermined loop height, or other loop height; the loops are cut and finished to a common pile height and the continuous web is exposed to heat to cause loop yarn to shrink to one or more different pile heights.

30 Claims, 17 Drawing Sheets

U.S. PATENT DOCUMENTS

| | | | | |
|---|---|---|---|---|
| 1,790,832 | A | 2/1931 | O'Lena | |
| 2,429,434 | A | 10/1947 | Underwood et al. | |
| 2,815,558 | A | 12/1957 | Albert et al. | |
| 2,884,680 | A | 5/1959 | Nowicki | |
| 3,030,691 | A | 4/1962 | Law | |
| 3,067,430 | A | 12/1962 | Wilcox | |
| 3,528,874 | A | 9/1970 | Spencer | |
| 3,607,591 | A | 9/1971 | Hansen | 161/77 |
| 3,850,783 | A | 11/1974 | Peters et al. | |
| 3,856,598 | A | 12/1974 | Gregorian et al. | |
| 4,018,956 | A | 4/1977 | Casey | |
| 4,112,560 | A | 9/1978 | Willbanks | |
| 4,418,451 | A | 12/1983 | Crenshaw | |
| 4,756,958 | A | 7/1988 | Bryant et al. | 428/320.2 |
| 4,851,291 | A | 7/1989 | Vigo et al. | 428/393 |
| 4,871,615 | A | 10/1989 | Vigo et al. | 428/398 |
| 5,204,156 | A | 4/1993 | Lumb et al. | 428/96 |
| 5,268,212 | A | 12/1993 | Lumb et al. | 428/96 |
| 5,312,667 | A | 5/1994 | Lumb et al. | 428/91 |
| 5,364,678 | A | 11/1994 | Lumb et al. | 428/96 |
| 5,366,801 | A | 11/1994 | Bryant et al. | 428/283 |
| 5,388,271 | A | 2/1995 | Sessoms | |
| 5,469,581 | A | 11/1995 | Uthoff | |
| 5,885,475 | A | 3/1999 | Salyer | 252/70 |
| 5,906,877 | A | 5/1999 | Popper et al. | 428/92 |
| 6,004,662 | A | 12/1999 | Buckley | 428/304.4 |
| 6,035,749 | A | 3/2000 | Haselwander | |
| 6,041,437 | A | 3/2000 | Barker et al. | 2/82 |
| 6,076,242 | A | 6/2000 | Kasaoka et al. | |
| 6,125,645 | A | 10/2000 | Horn | 62/259.3 |
| 6,179,879 | B1 | 1/2001 | Robinson et al. | 8/94.21 |
| 6,194,322 | B1 | 2/2001 | Lilleland et al. | 438/710 |
| 6,194,332 | B1 | 2/2001 | Rock et al. | 442/312 |
| 6,263,511 | B1 | 7/2001 | Moretti | 2/97 |
| 6,312,784 | B2 | 11/2001 | Russell et al. | 428/101 |
| 6,332,221 | B1 | 12/2001 | Gracey | |
| 6,381,482 | B1 | 4/2002 | Jayaraman et al. | 600/388 |
| 6,602,811 | B1 | 8/2003 | Rock et al. | 442/312 |
| 6,674,535 | B1 | 1/2004 | Kim | 358/1.15 |
| 6,689,466 | B2 | 2/2004 | Hartmann | 428/402.2 |
| 6,779,368 | B2 | 8/2004 | Rock et al. | |
| 6,793,856 | B2 | 9/2004 | Hartmann et al. | 264/141 |
| 6,855,410 | B2 | 2/2005 | Buckley | 428/311.11 |
| 6,855,422 | B2 | 2/2005 | Magill et al. | 428/373 |
| 6,881,219 | B1 | 4/2005 | Agarwal et al. | 607/108 |
| 7,027,699 | B2 | 4/2006 | Tao et al. | 385/126 |
| 7,217,456 | B1 | 5/2007 | Rock et al. | |
| 7,428,772 | B2 * | 9/2008 | Rock | 28/159 |
| 7,743,476 | B2 * | 6/2010 | Rock et al. | 28/160 |
| 2002/0122914 | A1 | 9/2002 | Rock et al. | |
| 2004/0045143 | A1 | 3/2004 | Rock et al. | |
| 2004/0132367 | A1 | 7/2004 | Rock | |
| 2004/0170799 | A1 | 9/2004 | Carr et al. | |
| 2005/0003139 | A1 | 1/2005 | Keller | |
| 2005/0075028 | A1 * | 4/2005 | Rock et al. | 442/318 |
| 2005/0095940 | A1 * | 5/2005 | Rock et al. | 442/304 |
| 2005/0204448 | A1 | 9/2005 | Wise et al. | |

FOREIGN PATENT DOCUMENTS

| | | |
|---|---|---|
| EP | 1 338 691 A1 | 8/2003 |
| FR | 2 549 503 | 1/1985 |
| WO | WO 01/73178 A1 | 10/2001 |

OTHER PUBLICATIONS

Supplementary European Search Report, European Application No. EP 05 76 3638, Apr. 1, 2008, 3 pages.

* cited by examiner

ENGINEERED FABRIC ARTICLES

CROSS-REFERENCE TO RELATED APPLICATIONS

Pursuant to 35 USC §120, this application is a continuation application and claims the benefit of U.S. application Ser. No. 11/569,041, filed Nov. 13, 2006 now U.S. Pat. No. 7,743,476, now allowed, which in turn claims priority to International Application No. PCT/US2005/022479, filed Jun. 23, 2005, which claims the benefit of U.S. Provisional Application No. 60/582,674 filed on Jun. 24, 2004 now abandoned, U.S. Provisional Application No. 60/605,563 filed on Aug. 30, 2004, U.S. Provisional Application No. 60/626,191 filed on Nov. 9, 2004 and U.S. Provisional Application No. 60/682,695 filed on May 19, 2005. The complete disclosures of the above-referenced applications are hereby incorporated by reference in their entireties.

TECHNICAL FIELD

This disclosure relates to thermal fabric articles, e.g. for use in garments, home textile articles, such as blankets, and upholstery covers.

BACKGROUND

Thermal garment layering is considered one of the more effective means for personal insulation available. Active people use it extensively. However, layered garments typically add bulk and can impair a wearer's range of motion. Furthermore, with layered garments, it is often difficult to provide levels of insulation appropriate for all areas of the wearer's body, as different areas of the body have different sensitivities to temperature and different abilities to thermoregulate, e.g., by sweating.

Prior art fabric articles endeavoring to offer regions of differing rates of heat and/or vapor exchange, e.g. as described in U.S. Pat. Nos. 6,332,221 and 5,469,581, typically have numerous seams for joining together multiple different areas and/or layers of the fabric articles, which increase production costs associated with cutting, piecework and sewing, and increase waste. Seams are also prone to failure and can be uncomfortable to, and even chafe the skin of, a wearer.

Similar issues arise in thermal layering of home textile articles, such as blankets and the like, and upholstery covers, e.g. for home furniture, for furniture in the institutional and contract markets, such as for offices, hotels, conference centers, etc., and for seating in transportation vehicles, such as automobiles, trucks, trains, buses, etc.

SUMMARY

The present disclosure is based, in part, on development of an engineered thermal fabric that can be used to make single layer engineered thermal articles, including, but not limited to, thermal fabric garments, addressing thermal insulation needs and comfort level, e.g., of active people, using a single layer garment, or a system of single layer garments, formed with a minimal number of seams, and also including home textile articles, such as blankets, and upholstery covers.

According to one aspect, a method of forming a unitary fabric element for use in an engineered thermal fabric article having a multiplicity of predetermined discrete regions of contrasting insulative capacity positioned about the article in an arrangement having correlation to insulative requirements, e.g. for warming and/or cooling or ventilation, moisture control, etc., of corresponding regions of a user's body, the unitary fabric element defining at least two predetermined, discrete regions of contrasting insulative capacity, comprises the steps of: designing a pattern of predetermined, discrete regions; combining yarn and/or fibers in a continuous web according to the pattern of predetermined, discrete regions, comprising the steps of, in one or more first discrete regions of the fabric element, forming loop yarn to a first pile height, including, e.g., low pile height or no pile height, the one or more first discrete regions corresponding to one or more regions of a user's body having a first insulative requirement, and in one or more other discrete regions of the fabric element, forming loop yarn to another pile height different from and relatively greater than the first pile height, the one or more other discrete regions corresponding to one or more regions of a user's body having other insulative requirements different from and relatively greater than the first insulative requirement; finishing one or both surfaces of the continuous web to form the predetermined, discrete regions into discrete regions of contrasting pile heights; and removing the unitary fabric element from the continuous web according to the pattern of predetermined, discrete regions.

Preferred implementations may include one or more of the following additional features and/or steps. Designing a pattern of predetermined, discrete regions comprises designing the pattern for use in an engineered thermal fabric garment. The unitary fabric element comprises a silhouette for an engineered thermal fabric garment and the method comprises the further steps of: forming a complementary unitary fabric element with a complementary pattern of predetermined, discrete regions, the complementary unitary fabric element comprising a complementary silhouette for the engineered fabric element; and joining together the unitary fabric element and the complementary unitary fabric element to form the engineered thermal fabric garment. Designing a pattern of predetermined, discrete regions comprises designing the pattern for use in an engineered thermal fabric home textile article. Designing a pattern of predetermined, discrete regions comprises designing the pattern for use in an engineered thermal fabric home textile article in the form of a blanket. Designing a pattern of predetermined, discrete regions comprises designing the pattern for use in an engineered thermal fabric home textile article in the form of an article selected from the group consisting of: mattress cover, mattress ticking, and viscoelastic mattress ticking. Designing a pattern of predetermined, discrete regions comprises designing the pattern for use in an engineered thermal fabric upholstery cover. Combining yarn and/or fibers in a continuous web according to the pattern of predetermined, discrete regions comprises combining yarn and/or fibers by use of electronic needle and/or sinker selection. Forming loop yarn to a first pile height and to another pile height comprises forming loops at the technical back (as oriented coming off the knitting machine) of the unitary fabric element. Combining yarn and/or fibers in a continuous web comprises combining yarn and/or fibers by tubular circular knitting, e.g., by reverse plaiting. Preferably, finishing one or both surfaces of the continuous web comprises finishing one surface of the continuous web to form a single face fleece or comprises finishing both surfaces of the continuous web to form a double face fleece. Combining yarn and/or fibers in a continuous web by tubular circular knitting comprises combining yarn and/or fibers by plaiting. Preferably, the method comprises combining the yarn and/or fibers by regular plaiting and finishing one surface of the continuous web to form a single face fleece or the method comprises combining the yarn and/or fibers by reverse plaiting and finishing both surfaces of the continuous web to form a double face fleece. Combining yarn and/or fibers in a continuous web comprises combining yarn and/or fibers by warp knitting. Combining yarn and/or fibers in a continuous web comprises combining yarn and/or fibers to form a woven fabric element. Finishing one or both surfaces of the continuous web to form predetermined, discrete regions into discrete regions of contrasting pile heights comprises raising one surface or both surfaces. Combining yarn and/or fibers in a continuous web comprises combining yarn and/or fibers to form a fully fashion knit fabric body. Finishing one or both surfaces of the continuous web to form predetermined, discrete regions into discrete regions of contrasting pile heights comprises cutting selected loops on one surface of the technical back, e.g., cutting all the loops for fabrics with loop and no-loop regions or cutting only higher loops for fabrics with different loop height regions, and raising the opposite surface. Finishing one or both surfaces of the continuous web comprises applying a chemical resin or chemical binder to one or more predetermined discrete regions of one surface or both surfaces of the continuous web, and finishing the one surface or both surfaces, the predetermined discrete regions resisting raising. Applying a chemical resin or chemical material to one or more predetermined discrete regions is synchronized with wet printing in other predetermined regions. Finishing one or both surfaces of the continuous web comprises applying a hard face chemical resin or chemical binder to one surface or to both surfaces to improve pill resistance and/or abrasion resistance. The method comprises the further step of incorporating the unitary fabric element in a unitary fabric laminate, e.g. with a controlled air permeability element. Incorporating the unitary fabric element in a unitary fabric laminate with a controlled air permeability element comprises selecting a controlled air permeability element from the group consisting of perforated membrane, crushed adhesive as a layer, foam adhesive as a layer, discontinuous breatheable membrane, and porous hydrophobic breatheable film and non porous hydrophilic breatheable film. Incorporating the unitary fabric element in a unitary fabric laminate comprises laminating the unitary fabric element with an air and liquid water impermeable element in the form of a breatheable film. Incorporating the unitary fabric element in a unitary fabric laminate with an air and liquid water impermeable element in the form of a breatheable film comprises the further step of selecting a breatheable film from the group consisting of porous hydrophobic film and non-porous hydrophilic film. The unitary fabric laminate has a raised inner side with a no-loop or low-loop region along a seam edge and the method comprises the further steps of: joining together the unitary fabric laminate and a complementary unitary fabric laminate with a seam along a seam edge, and applying a narrow band of thermoplastic tape with heat and pressure over the seam in the no-loop or low-loop region on the inner side. The unitary fabric laminate has a raised inner side and the method comprises the further steps of: forming a no-loop or low-loop region adjacent to a raised inner side region, and folding the no-loop or low-loop region to form a double fabric layer region without double bulk of the raised inner side region. The method comprises forming the no-loop or low-loop region adjacent to a fabric edge, and may further comprise securing the no-loop or low-loop region in folded state. Alternatively, the method comprises forming the no-loop or low-loop region about a predetermined fold in the engineered thermal fabric article. Combining yarn and/or fibers in a continuous web comprises the further step of incorporating fibers of stretch and/or elastic materials in the stitch yarn. Combining yarn and/or fibers in a continuous web comprises combining yarn and/or fibers of one or more materials selected from the group consisting of: synthetic yarn and/or fibers, natural yarn and/or fibers, regenerate yarn and/or fibers, and specialty yarn and/or fibers. The synthetic yarn and/or fibers is selected from the group consisting of: polyester yarn and/or fibers, nylon yarn and/or fibers, acrylic yarn and/or fibers, polypropylene yarn and/or fibers, and continuous filament flat or textured or spun yarn made of synthetic staple fibers. The natural yarn and/or fibers are selected from the group consisting of: cotton yarn and/or fibers and wool yarn and/or fibers. The regenerate yarn and/or fibers are selected from the group consisting of: rayon yarn and/or fibers. The specialty yarn and/or fibers is selected from the group consisting of: flame retardant yarn and/or fibers, e.g. flame retardant aramide yarn and/or fibers and flame retardant polyester yarn and/or fibers. Forming loop yarn to the first pile height comprises forming loop yarn to a low pile using low sinker and/or shrinkable yarn. Forming loop yarn to the first pile height comprises forming loop yarn with no pile. Forming loop yarn to the first pile height comprises forming loop yarn to a low pile height using a combination of low pile using low sinker and/or shrinkable yarn and no pile. Forming loop yarn to the first pile height comprises forming loop yarn to a low pile height of about 1 mm. Forming loop yarn to another pile height different from and relatively greater than the first pile height comprises forming loop yarn to a high pile height in the range of greater than about 1 mm up to about 20 mm. The multiplicity of predetermined discrete regions of contrasting insulative capacity positioned about the article in an arrangement having correlation to insulative requirements of corresponding regions of a user's body comprises discrete regions selected from the group consisting of: high pile, low pile, no pile and combinations thereof. The multiplicity of predetermined discrete regions of contrasting insulative capacity positioned about the article in an arrangement having correlation to insulative requirements of corresponding regions of a user's body comprises discrete regions selected from the group consisting of: high sinker loop, low sinker loop, no pile and combinations thereof. The multiplicity of predetermined discrete regions of contrasting insulative capacity positioned about the article in an arrangement having correlation to insulative requirements of corresponding regions of a user's body comprises discrete regions selected from the group consisting of: high tortuosity, low tortuosity, open construction and combinations thereof. The one or more first discrete regions and the one or more other discrete regions correspond to one or more regions of a user's body selected from the group consisting of: spinal cord area, spine, back area, upper back area, lower back area, neck area, back of knee areas, front of chest area, breast area, abdominal area, armpit areas, arm areas, front of elbow areas, sacrum dimple areas, groin area, thigh areas, and shin areas, the regions of a user's body being described as follows:

Spine: This area extends along the center of the back covering the entire length and breadth of the chain of 29 vertebrae, from the uppermost vertebra (C1) in the center base of the skull to the lowermost vertebra (S4) in the central lower portion of the hips. Beginning with the uppermost vertebra and working downwards, the groups of vertebrae are as follows; the cervical or "neck" vertebrae (C1-C7 inclusive), the thoracic or "back" vertebrae (T1-T12 inclusive), the lumbar or "small of the back" vertebrae (L1-LS inclusive) and, finally, the sacral or "lower end of the hips" vertebrae (S1-S5 inclusive) (hereinafter referred to as the "spinal cord area"). (The lowermost portion of the spine itself is the coccygeal section of vertebrae (C1-C4 inclusive).

Back: This area extends between the back of the neck and the waist, and hereinafter is referred to as the "back area." The "upper back area" includes the area including the shoulder blades. The "lower back area" includes the small of the back and the back of the waist.

Front and back of the neck: This area, where there is a relative absence of fat pads, is characterized by a relatively higher concentration of nervous tissue close to the skin surface. It is hereinafter referred to as the "neck area."

Backs of the knees: This area hereinafter is referred to as the "back of knee areas."

Front of the chest: This area, where there is a relative absence of fat pads and a relatively higher concentration of nervous tissue close to the skin surface, is hereinafter referred to as the "front of chest area."

Below the breasts: This area, located just below the breasts and not protected by fat pads, hereinafter is referred to as the "breast area."

Abdomen: This area, located between the breasts and the waist, hereinafter is referred to as the "abdominal area."

Armpits: These areas, not protected by fat pads, sweat relatively more and have relatively higher concentrations of lymph glands close to the skin surface. Hereinafter they are referred to as the "armpit areas."

Arms: These areas, including the entire length of the arm, from shoulder to wrist, i.e., a long sleeve, are hereinafter referred to as the "arm areas."

Fronts of elbows: These areas are hereinafter referred to as the "front of elbow areas."

Groin: This area, not protected by fat pads, sweats relatively more, and has reproductive tissues and/or organs and relatively higher concentrations of lymph glands close to the skin surface. It is hereinafter referred to as the "groin area."

Knees and shins: These areas, not protected by fat pads, hereinafter are referred to as the "shin areas."

Sacrum dimples: These areas located at the top of the sacrum region are hereinafter referred to as the "sacrum dimple areas."

The method further comprises laminating a breatheable membrane between a knit surface region of no loop yarn and a knit surface region with velour of at least one pile height, e.g. low, high and/or any combinations thereof. The method further comprises the step of finishing the technical face and the technical back of the fabric body in a manner to preserve, enhance, and/or create contrasting levels of bulk and to form one or more fleece surface regions. Loop yarn in the one or more first discrete regions of the fabric element has a first shrinkage performance and loop yarn in the one or more other discrete regions of the fabric element has another shrinkage performance different from the first shrinkage performance, and the method comprises the further step of: exposing the continuous web to heat in a manner to cause loop yarn having a first shrinkage performance to shrink to form to a first pile height and to cause loop yarn having another shrinkage performance different from the first shrinkage performance to shrink to one or more other pile heights relatively greater than the first pile height. The method comprises the further steps of: in one or more discrete regions of the fabric element, forming loop yarn having a shrinkage performance different from shrinkage performance of loop yarn in one or more other discrete regions of the fabric element, and exposing the continuous web to heat in a manner to cause loop yarn having a shrinkage performance different from shrinkage performance in one or more other discrete regions of the fabric element to shrink to a different, lesser pile height. The method of forming a unitary fabric element for use in an engineered thermal fabric article comprises the further steps of forming a first surface with the predetermined, discrete regions, forming an opposite, second surface with plain loops, and raising and finishing the opposite second surface as fleece, velour or shearling.

According to another aspect, a method of forming a unitary fabric element for use in an engineered thermal fabric garment having a multiplicity of predetermined discrete regions of contrasting insulative capacity positioned about the garment in an arrangement having correlation to the insulative requirements of corresponding regions of a user's body, the unitary fabric element defining at least two predetermined, discrete regions of contrasting insulative capacity, comprises the steps of: designing a pattern of predetermined, discrete regions; combining yarn and/or fibers in a continuous web on a knitting machine according to the pattern of the predetermined, discrete regions, comprising, in one or more first discrete regions of the fabric element, forming loop yarn having a first shrinkage performance to loops of a predetermined loop height, the one or more first discrete regions corresponding to one or more regions of the user's body having first insulative requirements, and in one or more other discrete regions of the fabric element, forming loop yarn having another shrinkage performance different from the first shrinkage performance to loops of the predetermined loop height, the one or more other discrete regions corresponding to one or more regions of the user's body having other insulative requirements different from and relatively greater than the first insulative requirements; cutting the loops of the one or more first discrete regions and the loops of the one or more other discrete regions of the continuous web while on the knitting machine; finishing the cut loops of the one or more first discrete regions and the cut loops of the one or more other discrete regions to a common pile height; exposing the continuous web to heat in a manner to cause cut loop yarn having a first shrinkage performance to shrink to form pile to a first pile height and to cause cut loop yarn having another shrinkage performance different from the first shrinkage performance to shrink to one or more other pile heights relatively greater than the first pile height; finishing, e.g. by raising or napping, one or both surfaces of the continuous web to form the predetermined, discrete regions into discrete regions of contrasting pile heights; and removing the unitary fabric element from the continuous web according to the pattern of predetermined, discrete regions.

Preferred implementations may include one or more of the following additional features and/or steps. The first shrinkage performance is in the range of about 20% shrinkage to about 60% shrinkage, and preferably in the range of about 0% shrinkage to about 10% shrinkage.

According to still another aspect, a method of forming a unitary fabric element for use in an engineered thermal fabric article having a multiplicity of predetermined discrete regions of contrasting insulative capacity positioned about the article in an arrangement having correlation to insulative requirements of corresponding regions of a user's body, the unitary fabric element defining at least two predetermined, discrete regions of contrasting insulative capacity, comprises designing a pattern of the predetermined, discrete regions; combining yarn and/or fibers in a continuous web on a knitting machine according to the pattern of the predetermined, discrete regions, comprising, in one or more first discrete regions of the fabric element, forming no pile regions, the one or more first discrete regions corresponding to one or more regions of the user's body having first insulative requirements, and in one or more other discrete regions of the fabric element, forming loop yarn having at least a first predetermined shrinkage performance to loops of a predetermined loop height, the one or more other discrete regions corresponding to one or more regions of the user's body having other insulative requirements different from and relatively greater than the first insulative requirements; cutting the loops of the one or more other discrete regions of the continuous web while on the knitting machine; finishing the cut loops of the one or more other discrete regions to a common pile height; exposing the continuous web to heat in a manner to cause cut loop yarn having at least a first predetermined shrinkage performance to shrink to form pile to at least a first pile height; finishing one or both surfaces of the continuous web to form the predetermined, discrete regions into discrete regions of contrasting pile heights; and removing the unitary fabric element from the continuous web according to the pattern of predetermined, discrete regions.

Preferred implementations of both of these aspects of the method may include one or more of the following additional features. The unitary fabric element comprises a silhouette for the engineered thermal fabric garment and the method comprises the further steps of: forming a complementary unitary fabric element with a complementary pattern of predetermined, discrete regions, the complementary unitary fabric element comprising a complementary silhouette for the engineered fabric element; and joining together the unitary fabric element and the complementary unitary fabric element to form the engineered thermal fabric garment. Combining yarn and/or fibers in a continuous web according to a pattern of predetermined, discrete regions comprises combining yarn and/or fibers and determining pile height by controlling spacing between dial and cylinder. Forming loop yarn to the predetermined height comprises forming loops at the technical face of the unitary fabric element. Combining yarn and/or fibers in a continuous web comprises combining yarn and/or fibers by tubular circular knitting, e.g., by reverse plaiting. Finishing comprises finishing one surface of the continuous web to form a single face fleece or finishing both surfaces of the continuous web to form a double face fleece. Combining yarn and/or fibers in a continuous web by tubular circular knitting comprises combining yarn and/or fibers by regular plaiting. Finishing the continuous web comprises forming a single face fleece by regular plaiting, e.g. by raising the loop yarn on the technical back (or leaving it as a loop) and leaving the technical face smooth (unnapped). Combining yarn and/or fibers in a continuous web comprises combining yarn and/or fibers by warp knitting. Combining yarn and/or fibers in a continuous web comprised combining yarn and/or fibers to form a woven fabric element or to form a fully fashion knit fabric body. Finishing the continuous web to form predetermined, discrete regions into discrete regions of contrasting pile heights comprises raising one surface or both surfaces. Finishing one or both surfaces of the continuous web to form predetermined, discrete regions into discrete regions of contrasting pile heights comprises cutting selected loops on one surface and raising the opposite surface. Finishing one or both surfaces of the continuous web comprises applying a hard face chemical resin or chemical binder to one surface or to both surfaces to improve pill resistance and/or abrasion resistance. The method comprises the further step of: incorporating the unitary fabric element in a laminate, e.g. where the unitary fabric element is any knit with high and/or low and/or no pile and with or without stretch, e.g. in the stitch yarn, or the unitary fabric is a knit with or without a raised surface, or the unitary fabric is a woven with or without stretch. Incorporating the unitary fabric element in a laminate comprises laminating the unitary fabric element with a controlled air permeability element. Incorporating the unitary fabric element in a laminate with a controlled air permeability element comprises selecting a controlled air permeability element from the group consisting of: perforated membrane, crushed adhesive as a layer, foam adhesive as a layer, discontinuous breatheable membrane, porous hydrophobic breatheable film and non porous hydrophilic breatheable film. Incorporating the unitary fabric element in a unitary fabric laminate comprises laminating the unitary fabric element with an air and liquid water impermeable element in the form of a breatheable film. Incorporating the unitary fabric element in a unitary fabric laminate with an air and liquid water impermeable element in the form of a breatheable film comprises the further step of selecting a breatheable film from the group consisting of porous hydrophobic film and non porous hydrophilic film. A unitary fabric, selected from the group consisting of: single face unitary fabric element, double face unitary fabric element, and a unitary fabric laminate, has a raised inner side with a no-loop or low-loop region along a seam edge, and the method comprises the further steps of: joining together the unitary fabric and a complementary unitary fabric with a seam along a seam edge, and applying a narrow band of thermoplastic tape with heat and pressure over the seam in the no-loop or low-loop region on the inner side. A unitary fabric, selected from the group consisting of: single face unitary fabric element, double face unitary fabric element, and a unitary fabric laminate, has a raised inner side, and the method comprises the further steps of: forming a no-loop or low-loop region adjacent to a raised inner side region, and folding the no-loop or low-loop region to form a double fabric layer region without double bulk of the raised inner side region. Combining yarn and/or fibers in a continuous web comprises the further step of incorporating fibers of stretch and/or elastic material in the stitch yarn. Combining yarn and/or fibers in a continuous web comprises combining yarn and/or fibers of one or more materials selected from the group consisting of: synthetic yarn and/or fibers, natural yarn and/or fibers, regenerate yarn and/or fibers, and specialty yarn and/or fibers. The synthetic yarn and/or fibers is selected from the group consisting of: polyester yarn and/or fibers, nylon yarn and/or fibers, acrylic yarn and/or fibers, polypropylene yarn and/or fibers, and continuous filament flat or textured or spun yarn made of synthetic staple fibers. The natural yarn and/or fibers are selected from the group consisting of: cotton yarn and/or fibers and wool yarn and/or fibers. The regenerate yarn and/or fibers are selected from the group consisting of: rayon yarn and/or fibers. The specialty yarn and/or fibers is selected from the group consisting of flame retardant yarn and/or fibers, e.g., flame retardant aramide yarn and/or fibers, and flame retardant polyester yarn and/or fibers. Forming loop yarn to the first pile height comprises forming loop yarn to a low pile using low sinker and/or shrinkable yarn. Forming loop yarn to the first pile height comprises forming loop yarn to a low pile height, e.g., up to about 1 mm. The step of forming loop yarn to another pile height different from and relatively greater than the first pile height, comprises forming loop yarn to a high pile height, e.g. in the range of greater than about 1 mm up to about 20 mm. The multiplicity of predetermined discrete regions of contrasting insulative capacity positioned about the article in an arrangement having correlation to insulative requirements of corresponding regions of a user's body comprises discrete regions selected from the group consisting of: high pile, low pile and combinations thereof. The multiplicity of predetermined discrete regions of contrasting insulative capacity positioned about the article in an arrangement having correlation to insulative requirements of corresponding regions of a user's body comprises discrete regions selected from the group consisting of: high tortuosity, low tortuosity, open construction and combinations thereof. The multiplicity of predetermined discrete regions of contrasting insulative capacity positioned about the article in an arrangement having correlation to insulative requirements of corresponding regions of a user's body comprises discrete regions selected from the group consisting of: high pile, low pile, no pile and combinations thereof. The one or more first discrete regions and the one or more other discrete regions correspond to one or more regions of the user's body selected from the group consisting of: spinal cord area, spine, back area, upper back area, lower back area, neck area, back of knee areas, front of chest area, breast area, abdominal area, armpit areas, arm areas, front of elbow areas, sacrum dimple areas, groin area, thigh areas, and shin areas. The method further comprises finishing the technical face and the technical back of the fabric body in a manner to preserve, enhance, and/or create contrasting levels of bulk and to form the one or more fleece surface regions. The method comprises the further steps of: in one or more discrete regions of the fabric element, forming loop yarn to a pile height different from loop yarn pile heights in other discrete regions of the fabric element. The method comprises the further steps of, in the one or more other discrete regions of the fabric element, forming loop yarn having at least a first predetermined shrinkage performance and a second, significantly greater, predetermined shrinkage performance to loops of a predetermined loop height, and exposing the continuous web to heat in a manner to cause the cut loop yarn having at least a first predetermined shrinkage performance and a second, significantly great, predetermined shrinkage performance to generate a random, textured patterned. The loop yarn having at least a first predetermined shrinkage performance is relatively coarse and longer, and the loop yarn having the second, significantly greater, predetermined shrinkage performance comprises very fine micro fibers. According to yet another aspect, a unitary fabric element, and an engineered thermal fabric article, e.g. a thermal fabric garment, formed of the unitary fabric element, are formed by the methods of the disclosure, e.g. as described above. The engineered thermal fabric article may have the form of an engineered thermal fabric garment or the form of an engineered thermal fabric home textile article, e.g. a blanket, or mattress cover, mattress ticking, or viscoelastic mattress ticking, or the form of an engineered thermal fabric upholstery cover.

Implementations of this aspect include an engineered thermal fabric garment configured to be worn under body armor. In these implementations, the garment can include one or more sensors, wherein the sensors are configured to monitor conditions of a garment wearer or conditions of the garment relative to a garment wearer. In some implementations, the engineered thermal fabric garment includes spandex incorporated into the stitch. In yet another implementation, the engineered thermal fabric garment includes a no pile (no loop) region having a plaited construction.

According to another aspect, in a unitary fabric element, and in an engineered thermal fabric article, e.g. a thermal fabric garment, comprising the unitary fabric element, the unitary fabric element has a multiplicity of predetermined discrete regions of contrasting insulative capacity positioned about the article in an arrangement having correlation to insulative requirements of corresponding regions of a user's body. The unitary fabric element defines at least two predetermined, discrete regions of contrasting insulative capacity, comprising, in one or more first discrete regions of the fabric element, loop yarn having a first pile height, the one or more first discrete regions corresponding to one or more regions of the user's body having first insulative requirements, and, in one or more other discrete regions of the fabric element, loop yarn having another pile height different from and relatively greater than the first pile height, the one or more other discrete regions corresponding to one or more regions of the user's body having other insulative requirements different from and relatively greater than the first insulative requirements.

Preferred implementations of this aspect may include one or more of the following additional features. The engineered thermal fabric article has the form of an engineered thermal fabric garment. The engineered thermal fabric article further comprises a complementary unitary fabric element with a complementary pattern of predetermined, discrete regions, the complementary unitary fabric element and the unitary fabric element and the complementary unitary fabric element joined together to form an engineered thermal fabric garment. The engineered thermal fabric article has the form of an engineered thermal fabric home textile article, e.g. a blanket, or a mattress cover, mattress ticking, or viscoelastic mattress ticking. The engineered thermal fabric article has the form of an engineered thermal fabric upholstery cover. At least one surface is finished to form a single face fleece or both surfaces are finished to form a double face fleece. The yarn and/or fibers of the thermal fabric article or thermal fabric garment is combined by regular plaiting or by reverse plaiting, and finished to form a double face fleece, or by warp knitting or in a woven fabric element or in a fully fashion knit fabric body. An outer surface having a hard face chemical resin or chemical binder provides improved pill resistance and/or abrasion resistance. The engineered thermal fabric article or thermal fabric garment further comprises a unitary fabric laminate. The unitary fabric laminate comprises a controlled air permeability element. The controlled air permeability element is selected from the group consisting of: perforated membrane, crushed adhesive as a layer, foam adhesive as a layer, discontinuous breatheable membrane, porous hydrophobic breatheable film and non-porous hydrophilic breatheable film. The unitary fabric laminate further comprises an air and liquid water impermeable element in the form of a breatheable film. The air and liquid water impermeable element in the form of a breatheable film is select from the group consisting of: porous hydrophobic film and non-porous hydrophilic film. A unitary fabric, selected from the group consisting of: single face unitary fabric element, double face unitary fabric element, and a unitary fabric laminate, has a raised inner side with a no-loop or low-loop region along a seam edge, and the unitary fabric and a complementary unitary fabric secured together by a seam along a seam edge with a narrow band of thermoplastic tape with heat and pressure over the seam in the no-loop or low-loop region on the inner side. A unitary fabric, selected from the group consisting of: single face unitary fabric element, double face unitary fabric element, and a unitary fabric laminate, has a raised inner side with a no-loop or low-loop region adjacent to a raised inner side region, and the no-loop or low-loop region is folded to form a double fabric layer region without double bulk of the raised inner side region. The engineered thermal fabric article or thermal fabric garment further comprises fibers of stretch and/or elastic material incorporated in the stitch yarn. The thermal fabric article or thermal fabric garment is formed of yarn and/or fibers of one or more materials selected from the group consisting of: synthetic yarn and/or fibers, natural yarn and/or fibers, regenerate yarn and/or fibers, and specialty yarn and/or fibers. The synthetic yarn and/or fibers is selected from the group consisting of: polyester yarn and/or fibers, nylon yarn and/or fibers, acrylic yarn and/or fibers, polypropylene yarn and/or fibers, and continuous filament flat or textured or spun yarn made of synthetic staple fibers. The natural yarn and/or fibers are selected from the group consisting of: cotton yarn and/or fibers and wool yarn and/or fibers. The regenerate yarn and/or fibers are selected from the group consisting of: rayon yarn and/or fibers. The specialty yarn and/or fibers are selected from the group consisting of flame retardant yarn and/or fibers. The flame retardant yarn and/or fibers are selected from the group consisting of: flame retardant aramide yarn and/or fibers, and flame retardant polyester yarn and/or fibers. Discrete regions having a first pile height comprise loop yarn formed to a low pile using low sinker and/or shrinkable yarn. The multiplicity of predetermined discrete regions of contrasting insulative capacity positioned about the article in an arrangement having correlation to insulative requirements of corresponding regions of a user's body comprise discrete regions having pile heights selected from the group consisting of: first pile height, second pile height, no pile and combinations thereof. Discrete regions having a first pile height comprise one or more regions of loop yarn formed to a low pile height using low sinker and/or shrinkable yarn and one or more regions of no pile, and the one or more other discrete regions comprise loop yarn formed to a pile height relatively greater than the first pile height. The discrete regions having a first pile height comprise loop yarn formed to a low pile height of up to about 1 mm. The discrete regions having another pile height different from and relatively greater than the first pile height comprises loop yarn formed to a high pile height in the range of greater than about 1 mm up to about 20 mm in a single face fabric or greater than about 2 mm up to about 40 mm in a double face fabric. The multiplicity of predetermined discrete regions of contrasting insulative capacity positioned about the thermal fabric article or garment in an arrangement having correlation to insulative requirements of corresponding regions of a user's body comprise discrete regions selected from the group consisting of: high pile, low pile, no pile and combinations thereof. The multiplicity of predetermined discrete regions of contrasting insulative capacity positioned about the thermal fabric article or thermal fabric garment in an arrangement having correlation to insulative requirements of corresponding regions of a user's body comprise discrete regions selected from the group consisting of: high tortuosity, low tortuosity, open construction and combinations thereof. The discrete regions correspond to one or more regions of the user's body selected from the group consisting of: spinal cord area, spine, back area, upper back area, lower back area, neck area, back of knee areas, front of chest area, breast area, abdominal area, armpit areas, arm areas, front of elbow areas, sacrum dimple areas, groin area, thigh areas, and shin areas. The engineered thermal fabric article further comprises a breatheable membrane laminated between a knit surface region of no loop yarn and a knit surface region with velour of at least one pile height, e.g. low, high and/or any combinations thereof. The technical face and the technical back of the fabric body are finished in a manner to preserve, enhance, or create contrasting levels of bulk and form the one or more fleece surface regions. The engineered thermal fabric article or thermal fabric garment may be formed by any of the method or combinations of methods described above. The thermal fabric article or garment is configured to be worn under body armor. The engineered thermal fabric article or garment further comprises at least one sensor configured to monitor conditions of a garment wearer. The engineered thermal fabric article or garment further comprises at least one sensor configured to monitor conditions of the garment relative to a garment wearer. The engineered thermal fabric article or garment further comprises at least one sensor element incorporated in the stitch yarn. The engineered thermal fabric article or garment further comprises a no loop region having a plaited construction or having a jersey construction. The engineering thermal fabric article or garment has the form of an article of clothing or clothing accessory selected from the group consisting of: socks, gloves, hats, earmuffs, neck warmers, headbands, and balaclavas, or the form of a shoe insert, shoe insole or shoe lining. The unitary fabric element and the engineered thermal fabric article or garment formed of the element are formed by yarns comprising the one or more other discrete regions of the fabric element having at least a first predetermined shrinkage performance and a second, significantly greater, predetermined shrinkage performance and having a random, texture pattern surface, generated by exposure of the cut loop yarn having at least a first predetermined shrinkage performance and a second, significantly great, predetermined shrinkage performance to heat. The loop yarn having at least a first predetermined shrinkage performance is relatively coarse and longer, and the loop yarn having the second, significantly greater, predetermined shrinkage performance comprises very fine micro fibers.

According to yet another aspect, an engineered thermal fabric garment system comprises a first engineered thermal fabric garment having a multiplicity of predetermined discrete regions of contrasting insulative capacity positioned about the garment in an arrangement having correlation to the insulative requirements of corresponding regions of a user's body, and overlying the first engineered thermal fabric garment, in a system of overlying engineered thermal fabric garments, at least one second engineered thermal fabric garment having a multiplicity of predetermined discrete regions of contrasting insulative capacity positioned about the garment in an arrangement having correlation to the insulative requirements of corresponding regions of a user's body and having correlation to the multiplicity of predetermined discrete regions of contrasting insulative capacity positioned about the first engineered thermal fabric garment in the system.

Preferred implementations of this aspect may include one or more of the following additional features. The multiplicity of discrete regions of contrasting insulative capacity comprises discrete regions selected from the group consisting of high pile, low pile, no pile, and combinations thereof. The multiplicity of discrete regions of contrasting insulative capacity comprises discrete regions selected from the group consisting of: high tortuosity, low tortuosity, open construction, and combinations thereof.

According to yet another aspect, in a unitary fabric element and an engineered thermal fabric garment formed of the unitary fabric element, the unitary fabric element has plaited construction and a multiplicity of predetermined discrete regions of contrasting insulative capacity positioned about the garment in an arrangement having correlation to insulative requirements of corresponding regions of a user's body, the unitary fabric element defining at least two predetermined, discrete regions of contrasting insulative capacity, comprising one or more first discrete regions of the fabric element having a first pile height, the one or more first discrete regions corresponding to one or more regions of the user's body having first insulative requirements, and one or more other discrete regions of the fabric element having another pile height different from and relatively greater than the first pile height, the one or more other discrete regions corresponding to one or more regions of the user's body having other insulative requirements different from and relatively greater than the first insulative requirements, the unitary fabric element, for encouraging flow of liquid sweat from the inner layer toward the outer layer, comprises an outer layer formed of yarn and/or fibers of relatively fine dpf and an inner layer formed of yarn and/or fibers of relatively coarse dpf.

Preferred implementations of this aspect may include one or more of the following additional features. First discrete regions comprise open mesh, see-through construction for enhanced flow of air. The outer layer has a surface comprising one or more discrete regions of full knit with smooth, aerodynamic surface. The outer layer comprises one or more discrete regions having a textured surface. Discrete regions having a textured surface have a construction selected from the group consisting of: knit-tuck, knit-welt, and knit-welt-tuck. The inner layer comprises one or more discrete regions having a slightly brushed surface providing a relatively reduced number of touching points to a user's skin, for minimizing any clinging effect. The inner layer comprises synthetic fibers treated chemically to render the fibers hydrophilic. The outer layer comprises fibers of natural materials. The engineered thermal fabric garment further comprises spandex, for two-way stretch. The outer layer has anti-microbial properties, for minimizing body odors. The inner layer comprises fibers containing ceramic particles, for enhancing body heat reflection from a user's skin. The unitary fabric element of plaited construction comprises a unitary fabric element of double knit construction or a unitary fabric element of plaited jersey construction, e.g. double plaited jersey construction or triple plaited jersey construction.

A number of advantages are disclosed. For example, the engineered thermal fabric garments can be worn as a single layer that effectively replaces multiple layers of clothing, or multiple thermal fabric garments can be worn in an engineered thermal fabric garment system. The engineered thermal fabric garments allow a user to keep selected regions of the body warm, while allowing other regions of the body to be cooled by evaporation and/or ventilation. For example, selected regions such as the arms, or lower back, can be made to have higher insulative capacity, to keep athletes warm. In some implementations, either the right arm or the left arm may be more insulating, e.g., to keep the throwing arm of a pitcher warm while allowing the rest of the body to be cool. The formation of the garment as complementary single layer elements that are joined together (e.g., as the front and back of the garment) can reduce cutting and sewing costs and fabric wastage, and the smaller number of seams reduces potential failure points and can reduce chafing on the user's skin. Extremely intricate patterns of varying thickness can be achieved, and used to create infinitely varied regions of insulating warmth, range of motion and breatheability in the fabric, e.g., customized for any number of physical activities.

Similar advantages are realized for engineered thermal fabric articles in the form of home textile articles, such as blankets, or in the form of upholstery covers, e.g. for furniture for home, institutional and commercial markets, and for transportation seating. For example, home textile articles can be configured to provide discrete regions of insulation performance in a pattern corresponding to insulation requirements of a user's body. Engineered thermal fabric articles in the form of upholstery covers can be configured to provide discrete regions offering improved breatheability, more ventilation, and less sweat for different regions of a user's body, e.g., regions of a user's back.

Unless other reference is made, all technical and scientific terms used herein have the same meaning as commonly understood by a person of ordinary skill in the art to which this disclosure belongs. Although methods and materials similar or equivalent to those described herein can be used in the practice or testing of the present disclosure, suitable methods and materials are described below. In case of conflict, the present specification, including definitions, will control. In addition, the materials, methods, and examples are illustrative only and not intended to be limiting.

Other features and advantages of the disclosure will be apparent from the following detailed description, and from the claims.

DESCRIPTION OF DRAWINGS

FIG. 8 is a perspective view of a segment of a circular knitting machine, while

FIG. 32 is a somewhat diagrammatic side section view of another implementation of an engineered thermal fabric article, while

Like reference symbols in the various drawings indicate like elements.

DETAILED DESCRIPTION

Figure 1:
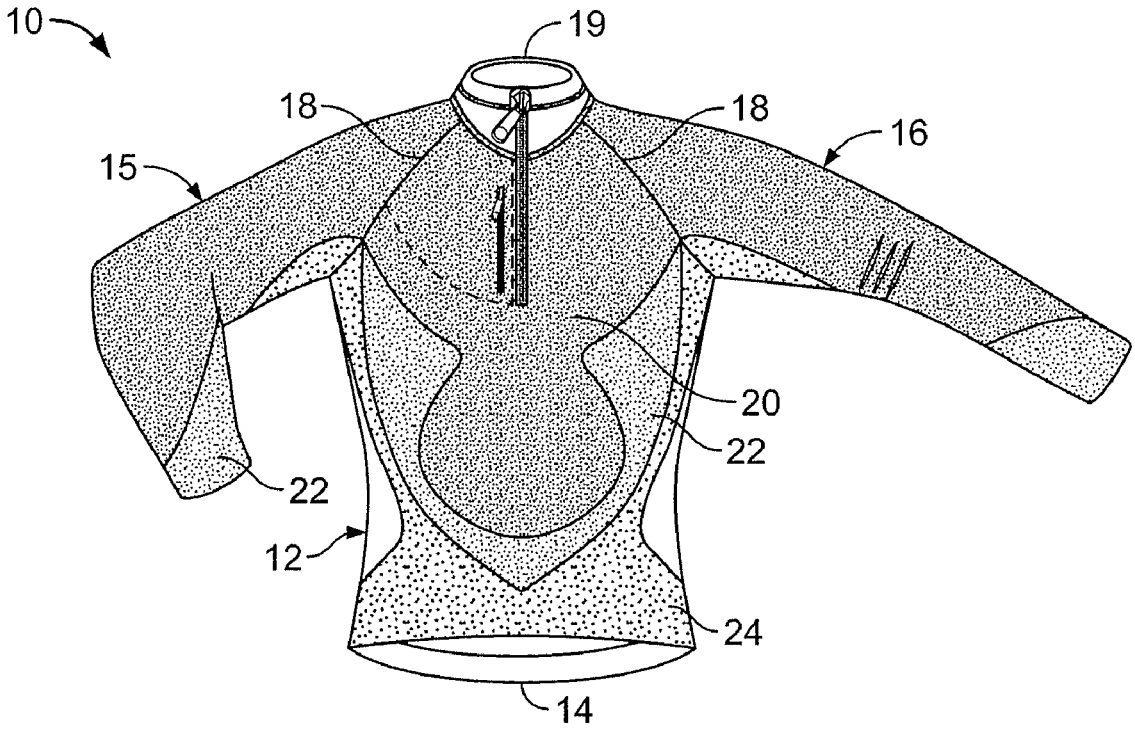
FIG. 1 is a front perspective view, partially in section, of an engineered thermal fabric article in the form of a thermal fabric garment formed of a single layer of engineered fabric, with regions of contrasting performance, e.g., insulation, wind-blocking, air circulation, etc., including regions of relatively high pile, regions of relatively low pile and/or regions of no pile disposed in correlation with body regions preferably requiring high insulation, intermediate insulation and little or no insulation, respectively.

Referring to FIG. 1, an engineered thermal fabric article in the form of a thermal fabric garment 10 has a front element 12, a rear element 14, and arm elements 15, 16. Each of the elements consists of a single layer of engineered thermal fabric. The elements are joined together, e.g., by stitching at seams 18. Each element defines one or more regions of contrasting performance, e.g., insulation, wind-blocking, air circulation (region 19), etc., including regions of relatively high pile 20, regions of relatively low pile 22 and regions of no pile 24 formed selectively across the elements in correlation with body regions preferably requiring high insulation, intermediate insulation and little or no insulation, respectively. Engineered thermal fabrics are created, and engineered thermal fabric articles, including engineered thermal fabric garments, are formed of such engineered thermal fabric elements, for the purpose of addressing thermal insulation and comfort level, e.g., of active people, using a single garment layer. The engineered thermal fabric articles reduce dependence on dressing in multiple layers, while providing insulation and comfort. The engineered thermal fabric articles, e.g. garments and home furnishings, such as blankets and the like, provide selected contrasting levels of insulation correlated to the requirements of the underlying regions of the body, to create an improved comfort zone suited for a wide variety of physical activities.

The engineered thermal fabric articles can be produced by any procedure suitable for creating regions with different pile heights and/or regions with no pile, in predetermined designs. Examples of suitable procedures include electronic needle and/or sinker selection, tubular circular or terry loop knit construction, e.g. by reverse plaiting (as described below with respect to FIGS. 8-15), to form double face fleece or to form pseudo single face fabric, where the jersey side can be protected by coating for abrasion or pilling resistance (as described below) or can be used as is for laminating, or by regular plaiting, to form single face fleece, warp knit construction, woven construction, and fully fashion knit construction. Any suitable yarn or fibers may be employed in forming the engineered thermal fabrics. Examples of suitable yarn or fibers include synthetic yarn or fibers formed, e.g., of polyester, nylon or acrylic; natural yarn or fibers formed, e.g., of cotton or wool; regenerate yarn or fibers, such as rayon; and specialty yarn or fibers, such as aramide yarn or fibers, as sold by E.I. duPont under the trademarks NOMEX® and KEVLAR®.

Figure 2:
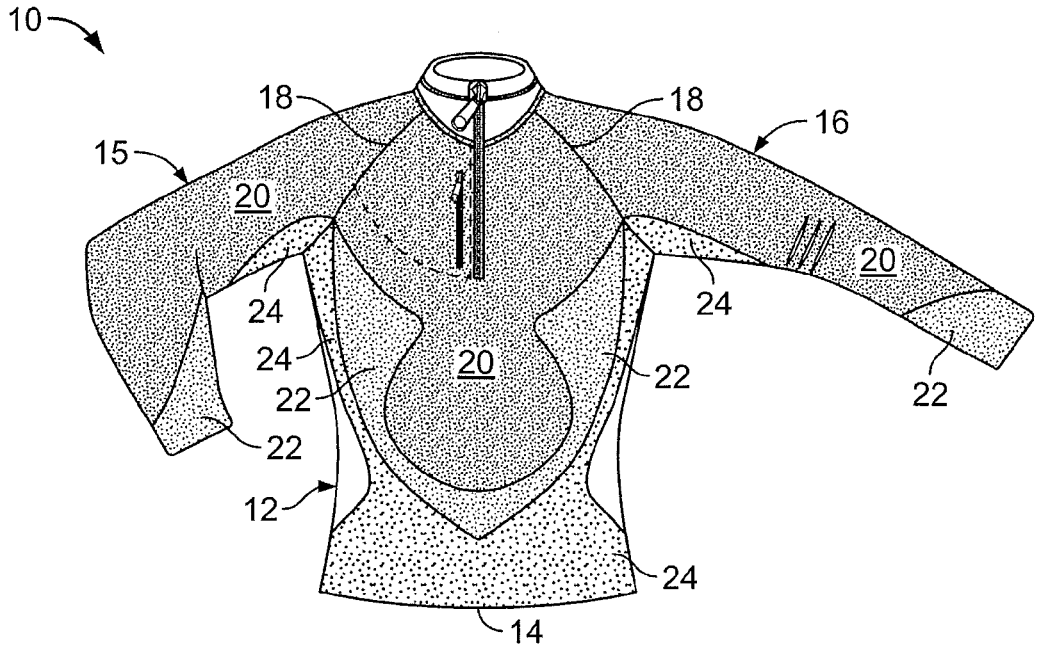
FIGS. 2 and 3 are front plan and rear plan views, respectively, of an engineered thermal fabric garment having regions of relatively high pile, regions of relatively low pile, and regions of no pile.
Figure 3:
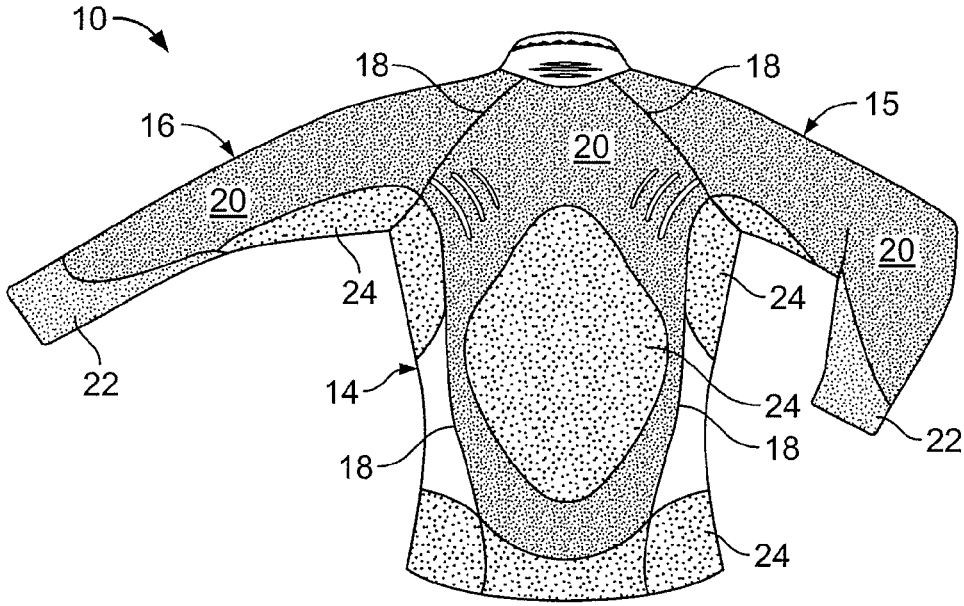
Figure 4:
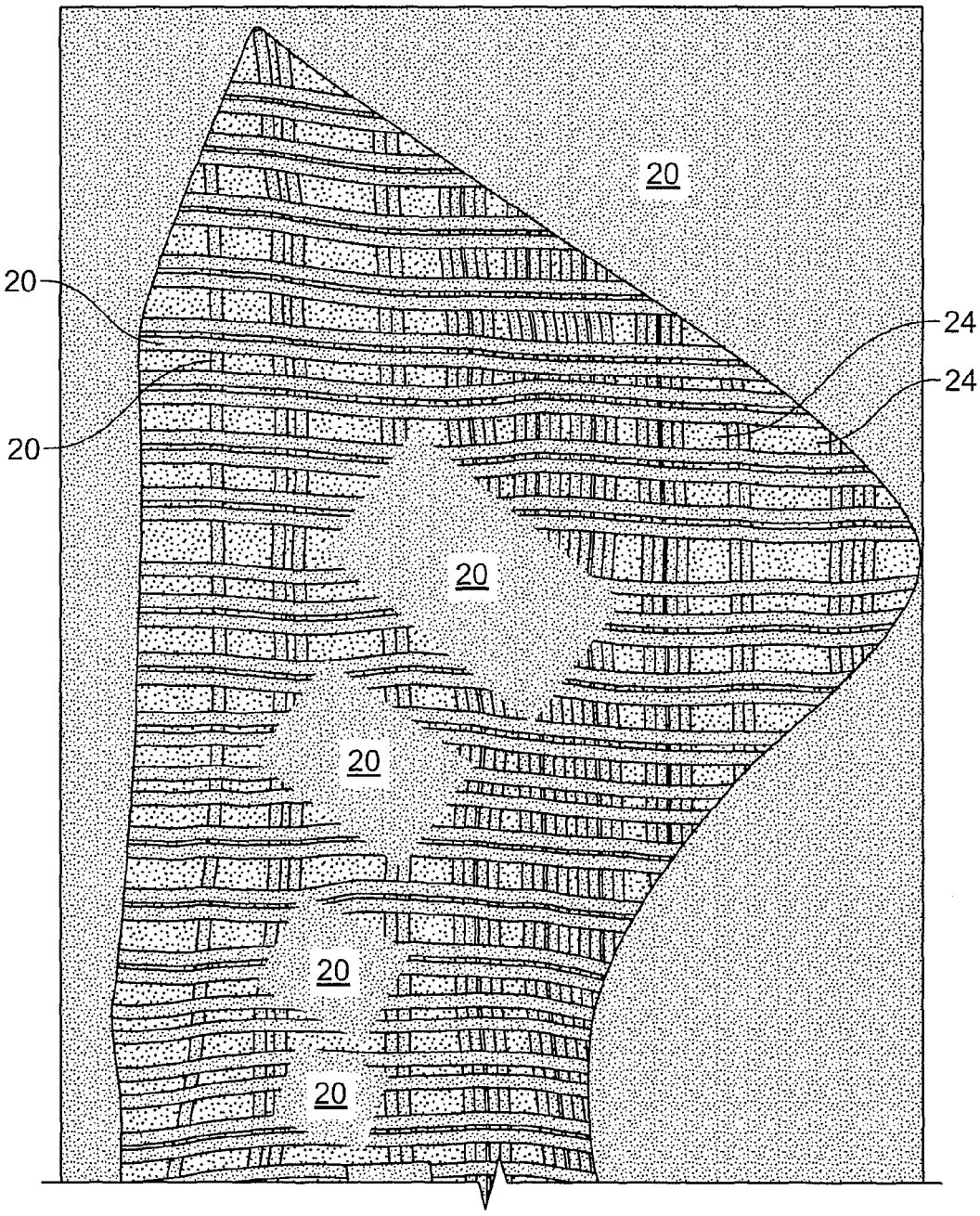
FIG. 4 is a representation of the surface of an engineered thermal fabric article formed with an intricate geometric pattern.
Figure 35:
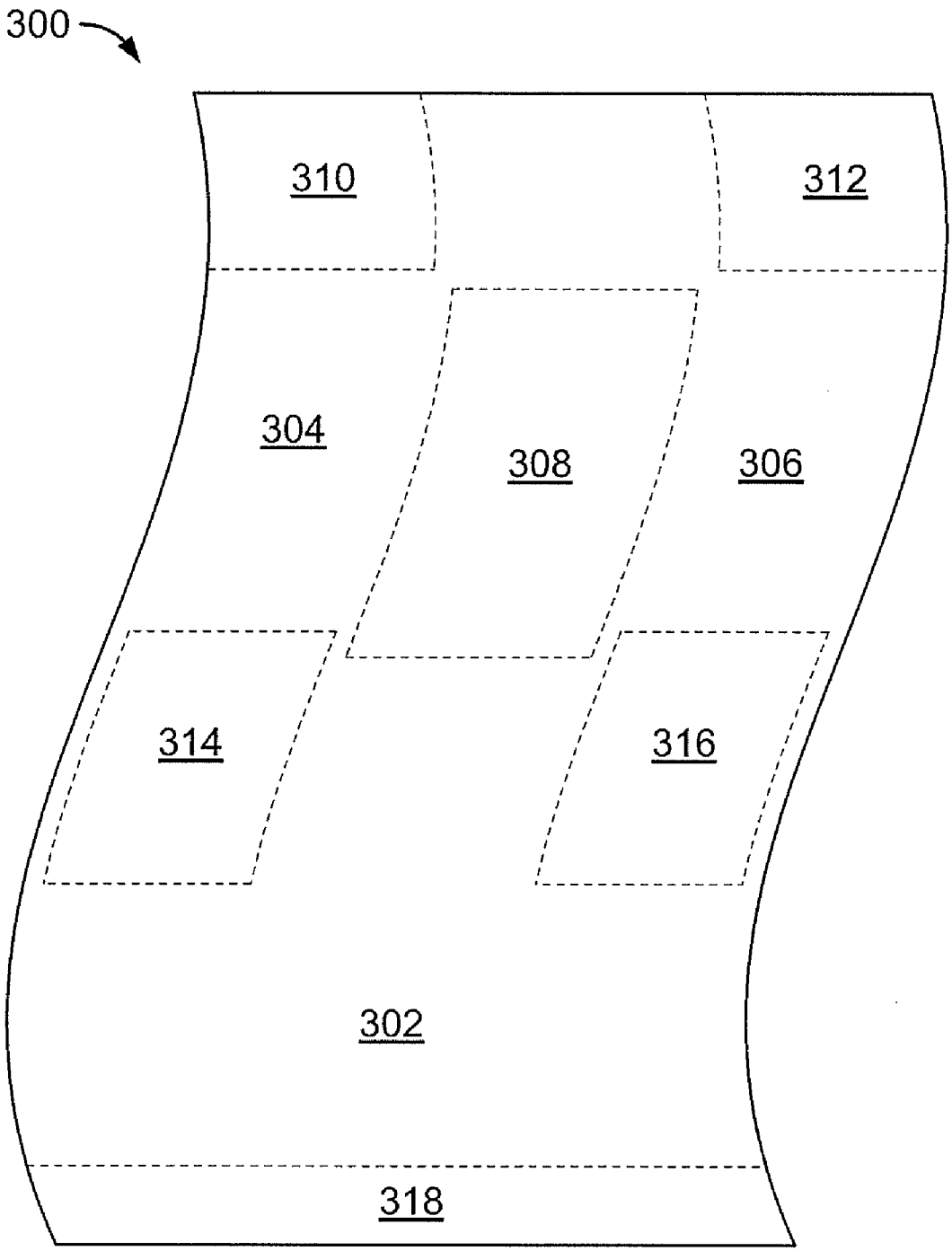
FIG. 35 is a somewhat diagrammatic plan view of another implementation of an engineered thermal fabric article, here, a home textile article in the form of a blanket, with regions of contrasting insulative capacity and performance, arranged by body mapping concepts.
Figure 36:
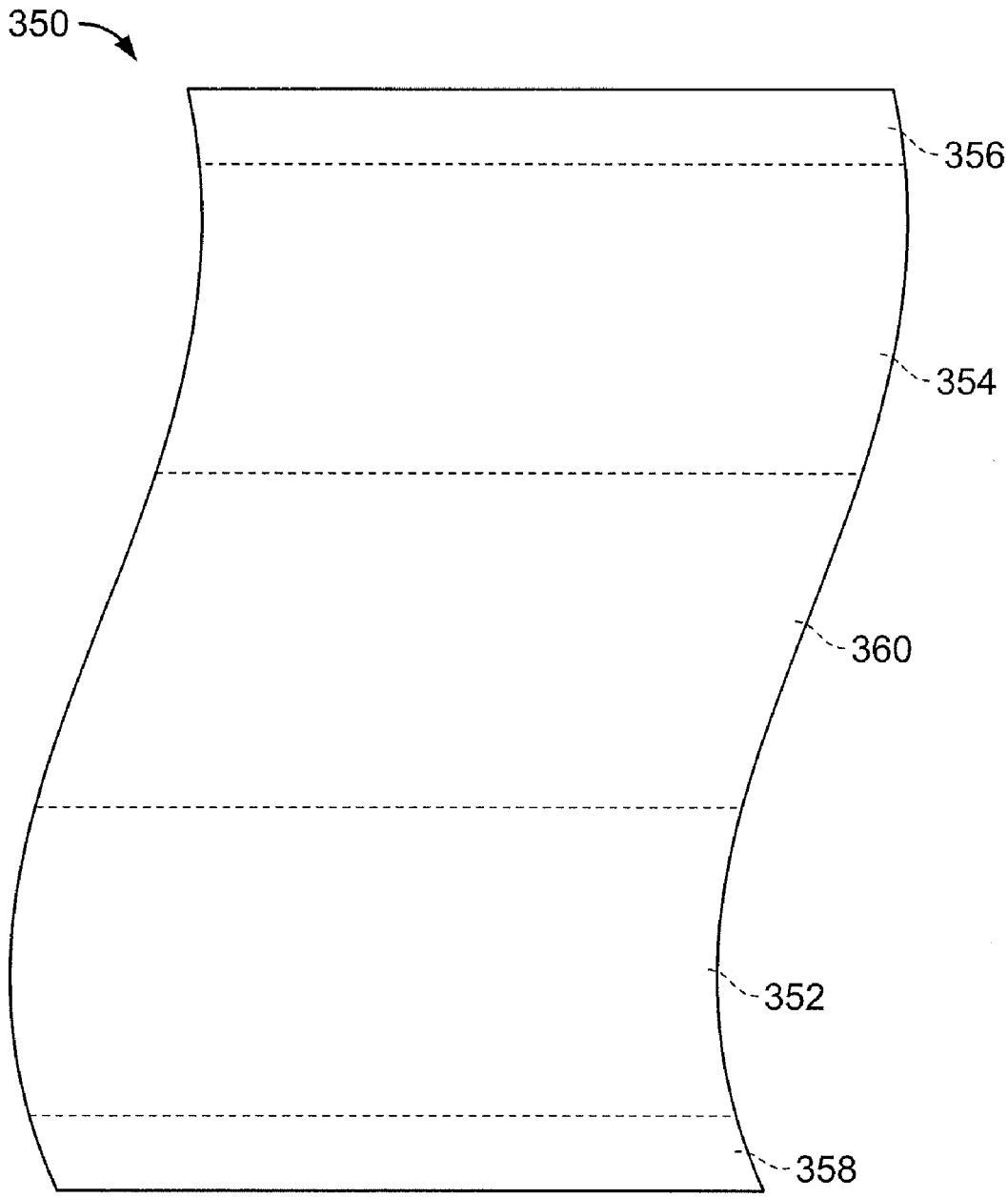
FIG. 36 is similar plan view of another implementation of an engineered thermal fabric home textile article in the form of a blanket, with band-form regions of contrasting insulative capacity and performance.

A pattern of contrasting pile height regions, including one or more regions with no loop pile yarn, is knitted, or otherwise formed, in a single layer fabric. Elements of the single layer fabric are then assembled to form an engineered thermal fabric article, e.g., an engineered thermal fabric garment 10, as shown in FIG. 1 and also in FIGS. 2 and 3, formed of a front silhouette or panel 12, a back silhouette or panel 14, and arm panels 15, 16, all joined along seams 18, or an engineered thermal fabric blanket, as shown in FIGS. 35 and 36 and described below in Examples 14 and 15. The patterns of the fabric elements are engineered to cover substantial portions of the body surface, each element typically having multiple regions of contrasting pile height and/or contrasting air permeability performance, thereby to minimize or avoid the cut-and-sew process typical of prior art thermal fabric articles. The disclosure thus permits construction of engineered thermal fabric articles with very intricate patterns of contrasting thickness, e.g. as shown in FIG. 4, which can be employed, e.g., as integral elements of a garment design. This level of intricacy cannot be achieved by standard cut and sew processes, e.g., simply sewing together a variety of fabric patterns and designs.

During processing, the engineered thermal fabric elements may be dyed, and one or both surfaces finished to form regions of contrasting pile loop height, e.g., by raising one or both surfaces, or by raising one surface and cutting the loops on the opposite surface. The degree of raising will depend on the pile height of the loop pile yarn. For example, the knit can be finished by cutting the high loops, or shearing just the high pile, without raising the low loop pile height and/or the no loop pile height. Alternatively, the knit can be finished by raising the loop surface; the high loop will be raised higher on finishing to generate relatively higher bulk/greater thickness, and thus have relatively increased insulative properties. Regions of contrasting bulk may also be obtained in a reverse circular knit terry construction by knitting two different yarns having significantly different shrinkage performance when exposed to dry or wet heat (e.g., steam or high temperature water) in a predetermined pattern. The very low shrinkage (0-10% shrinkage) yarn may be spun yarn, flat filament yarn or set textured yarn, and the high shrinkage yarn (20-60% shrinkage) may be heat sensitive synthetic yarn in flat yarn (like polypropylene) or high shrinkage polyester or nylon textured filament yarn. According to one implementation, the terry sinker loop yarn is cut on the knitting machine itself, where the velour height of the different yarns is identical, and the fabric is then exposed to high temperature (dry heat or wet heat) during dyeing to generate differences in relative pile height between contrasting regions of the two types of yarn, based on the contrast in shrinkage characteristics. Contrasting pile height may also be achieved by knitting one yarn into loops to be cut to a desired height on the knitting machine or later in the finishing process in combination with a low pile knitted to a zero pile height (e.g., a 0 mm sinker). The engineered thermal fabric articles may also include regions of no loop at all, to provide an additional contrasting level or height of pile (i.e., no pile).

The outer-facing surface (i.e., the technical back loop, or the technical face (jersey), where the latter is preferred for single face fabrics) of the engineered thermal fabric garments may also be treated with a resin or chemical binder to form a relatively hard surface for resistance to pilling and/or abrasions, e.g. as described in my pending U.S. patent application Ser. No. 10/700,405, filed Nov. 4, 2003 and my U.S. Provisional Application No. 60/501,110, filed Sep. 9, 2003.

Figure 5:
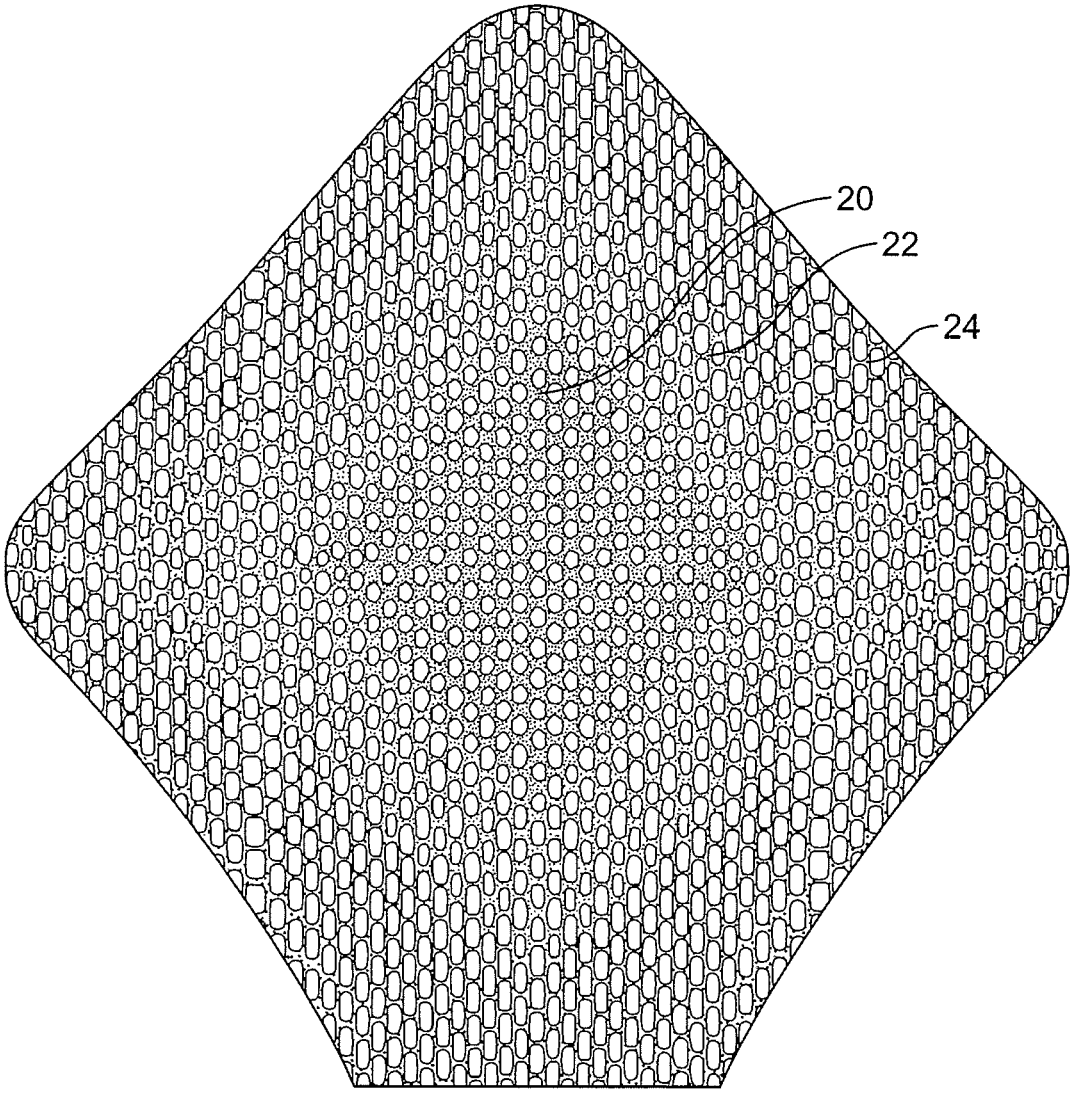
FIG. 5 is a perspective view of an engineered thermal fabric article, with regions of relatively high pile, regions of relatively low pile, and regions of no pile.

The pattern of contrasting pile heights, which may be varied to accommodate any predetermined design, can also be optimized for a variety of different physical activities. For example, referring to FIGS. 2 and 3, regions 20 of relatively higher pile can be situated to provide warmth in desired regions such as the chest and upper back, while regions 24 of the armpits and lower back can comprise regions of relatively lower pile and/or no pile. Referring also to FIG. 5, in some implementations of engineered thermal fabric articles, regions of patterns of thickness (e.g., stripes, plaids, dots and/or other geometric or abstract patterns, in any combination desired) can be used to create regions 22 of intermediate warmth and breatheability. The knit fabric construction will typically have some degree of stretch and recovery in the width direction. Significantly higher stretch and recovery, and stretch in both directions (length and width), can be provided as desired, e.g., for an engineered thermal fabric garment having enhanced comfort as well as body fit or compression, by incorporating elastomeric yarn or spandex, PBT or 3GT, or other suitable material, with mechanical stretch in the stitch yarn position.

In some implementations, in addition to being engineered for controlled insulation, the fabrics described above may be laminated to knit fabrics with velour of at least one pile height, e.g., low, high and/or any combination thereof, or to woven fabrics with or without stretch. Optionally, a membrane may be laminated between the layers of fabric to cause the laminate to be impermeable to wind and liquid water, but breatheable (e.g., a porous hydrophobic or non porous hydrophilic membrane), as in fabric product manufactured by Malden Mills Industries, Inc. and described in U.S. Pat. Nos. 5,204,156; 5,268,212 and 5,364,678. Alternatively, the laminate may be constructed to provide controlled air permeability (e.g., by providing an intermediate layer in the form of a perforated membrane, a crushed adhesive layer, a foam adhesive layer, or a discontinuous breatheable membrane), as in fabric product manufactured by Malden Mills Industries, Inc. and described in U.S. patent application Ser. Nos. 09/378,344; 09/863,852; 10/341,309 and 10/650,098.

Figure 6:
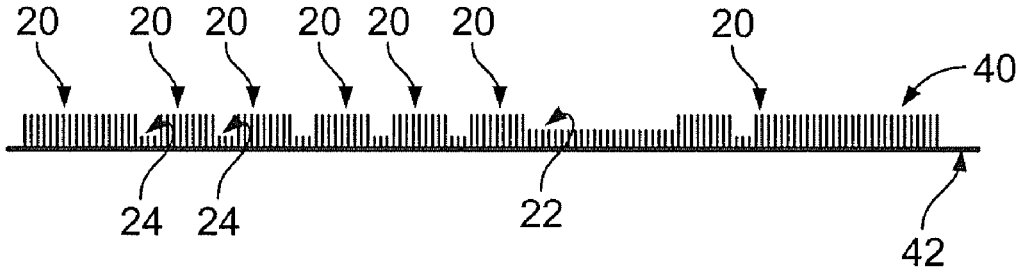
FIG. 6 is an end section view of an engineered thermal fabric article, with regions of relatively greater bulk, regions of no bulk, and regions of relatively lesser bulk on one surface.
Figure 7:
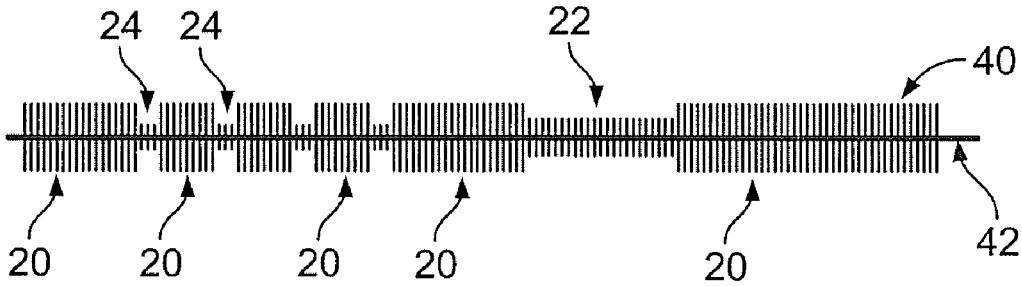
FIG. 7 is an end section view of another engineered thermal fabric article, with corresponding regions of relatively greater bulk, regions of no bulk, and regions of relatively lesser bulk on both surfaces.
Figure 8:
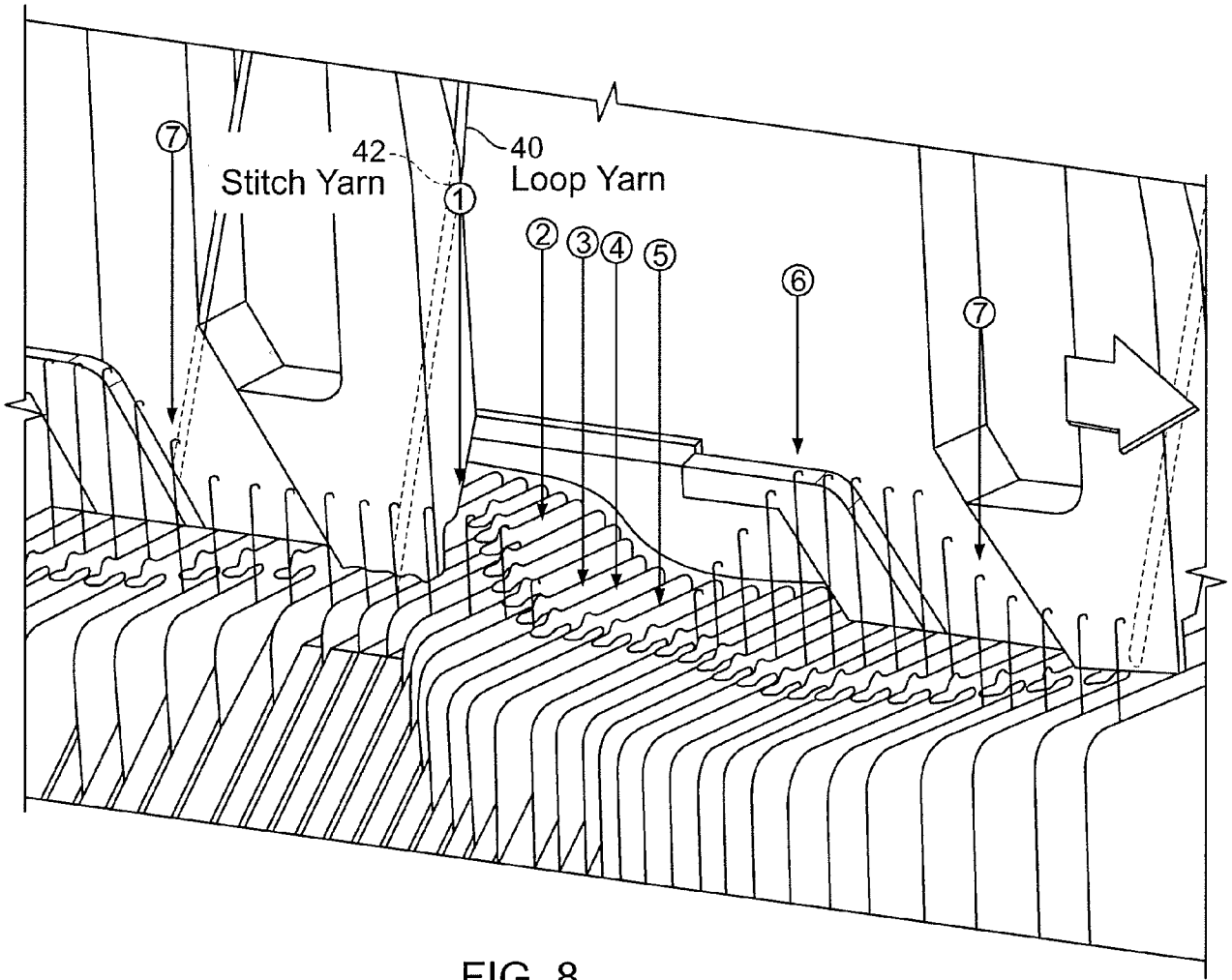
Figure 9:
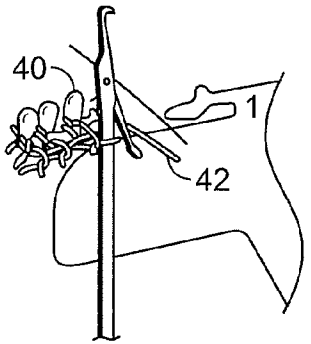
FIGS. 9-15 are sequential views of a cylinder latch needle in a reverse plaiting circular knitting process, e.g., for use in forming an engineered thermal fabric article.
Figure 10:
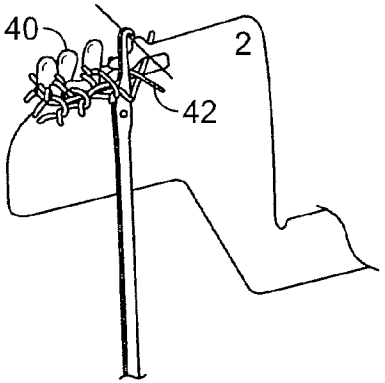
Figure 11:
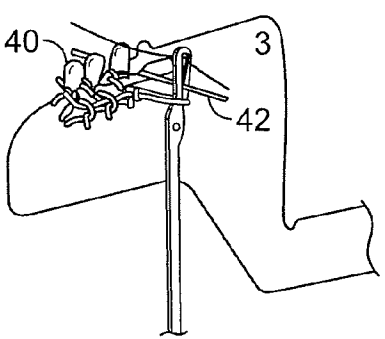
Figure 12:
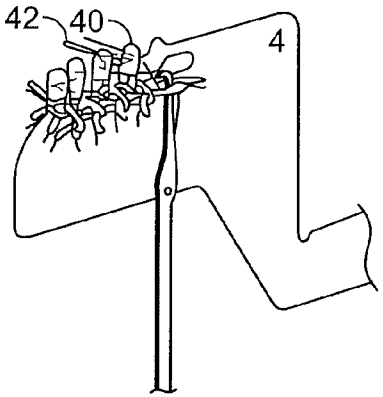
Figure 13:
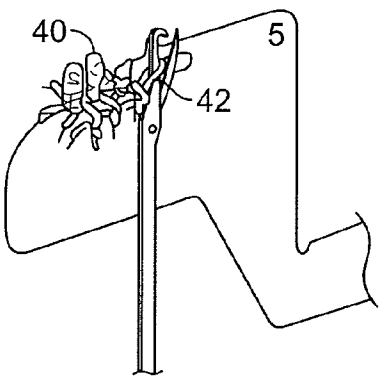
Figure 14:
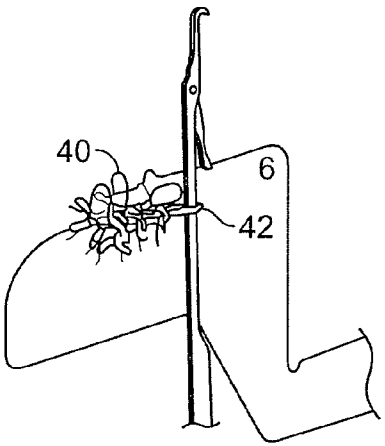
Figure 15:
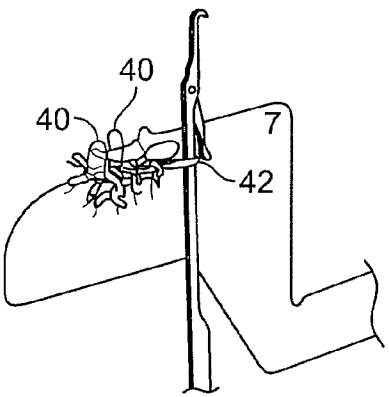

Referring now to FIG. 1, and also to FIGS. 6 and 7, engineered fabrics define regions of contrasting pile height, e.g., including regions 20 of relatively high pile, regions 22 of intermediate or low pile, and regions 24 of no pile, depending on the presence and height of loop yarn 40 relative to, i.e. above, stitch yarn 42. The engineered fabric prebody is thus formed according to a predetermined design, providing regions of relatively high pile 20, intermediate or low pile 22, or no pile 24. Referring to FIG. 5, in some implementations, regions 22 of intermediate insulation and breatheability may be achieved by a combination or overlap of regions 20 of relatively high pile with regions 24 of no pile.

Figure 16:
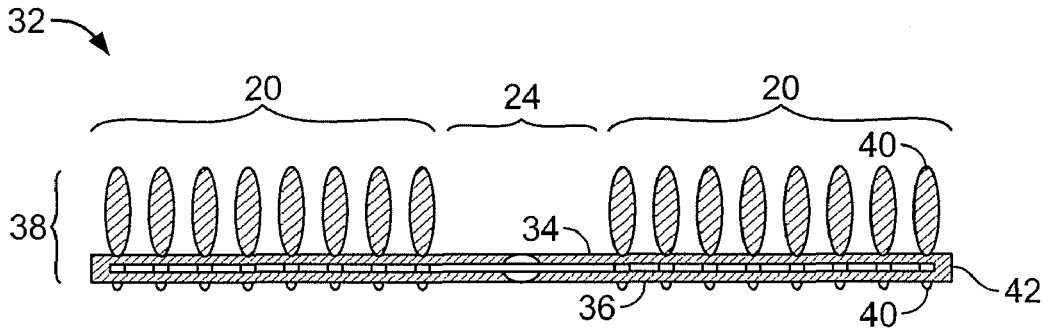
FIG. 16 is a somewhat diagrammatic end section view of a tubular knit fabric article formed during knitting.

Referring to FIGS. 8 and 9-15, according to one implementation, a fabric body 12 is formed (in a continuous web) by joining a stitch yarn 42 and a loop yarn 40 in a standard reverse plaiting circular knitting (terry knitting) process, e.g., as described in Knitting Technology, by David J. Spencer (Woodhead Publishing Limited, 2nd edition, 1996). Referring to FIG. 16, in the terry knitting process, the stitch yarn 42 forms the technical face 36 of the resulting fabric body and the loop yarn 40 forms the opposite technical back 34, where it is formed into loops (40, FIG. 14) extending to overlie the stitch yarn 42. In the fabric body 32 formed by reverse plaiting circular knitting, the loop yarn 40 extends outwardly from the planes of both surfaces and, on the technical face 36, the loop yarn 40 covers or overlies the stitch yarn 42 (e.g., see FIG. 16).

As described above, the loop yarn 40 forming the technical back 34 of the knit fabric body 32 can be made of any suitable synthetic or natural material. The cross section and luster of the fibers or filaments can be varied, e.g., as dictated by requirements of intended end use. The loop yarn 40 can be a spun yarn made by any available spinning technique, or a filament flat or textured yarn made by extrusion. The loop yarn denier is typically between 40 denier to 300 denier. A preferred loop yarn is a 200/100 denier T-653 Type flat polyester filament with trilobal cross section, e.g., as available commercially from E.I. duPont de Nemours and Company, Inc., of Wilmington, Del., or 2/100/96 texture yarn to increase tortuosity and reduce air flow, e.g., yarn from UNIFI, Inc., of Greensboro, N.C.

The stitch yarn 42 forming the technical face 36 of the knit fabric body 32 can be also made of any suitable type of synthetic or natural material in a spun yarn or a filament yarn. The denier is typically between 50 denier to 150 denier. A preferred yarn is a 70/34 denier filament textured polyester, e.g., as available commercially from UNIFI, Inc., of Greensboro, N.C. Another preferred yarn is cationic dyeable polyester, such as 70/34 T-81 from duPont, which can be dyed to hues darker or otherwise different from the hue of the loop yarn, to further accentuate a pattern.

In the preferred method, the fabric body 32 is formed by reverse plaiting on a circular knitting machine. This is principally a terry knit, where loops formed by the loop yarn 40 cover or overlie the stitch yarn 42 on the technical face 36 (see FIG. 16).

Figure 17:
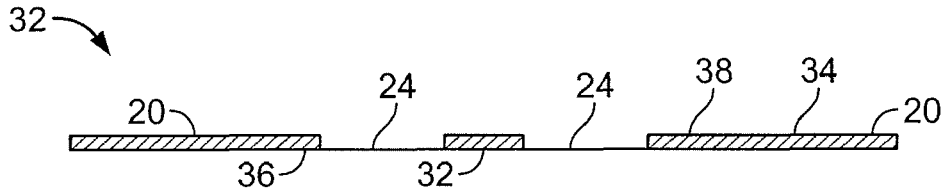
FIGS. 17 and 18 are somewhat diagrammatic end section views of engineered thermal fabric articles, finished on one surface and finished on both surfaces, respectively.
Figure 18:
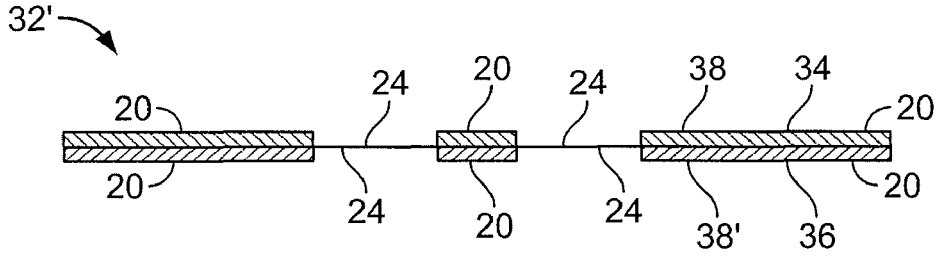

Referring now to FIGS. 17 and 18, during the finishing process, the fabric body 32, 32' can go through processes of sanding, brushing, napping, etc., to generate a fleece 38. The fleece 38 can be formed on one face of the fabric body 32 (FIG. 17), e.g., on the technical back 34, in the loop yarn, or fleece 38, 38' can be formed on both faces of the fabric body 32' (FIG. 18), including on the technical face 36, in the overlaying loops of the loop yarn and/or in the stitch yarn, with regions of high bulk 20 and low/no bulk 24. The fabric body 32, 32' can also be treated, e.g., chemically, to render the material hydrophobic or hydrophilic.

Referring to FIG. 4, in some implementations, the engineered thermal fabric may have regions 24 of relatively high pile interspersed with regions 20 of no pile arranged in intricate patterns, e.g., plaids, stripes, or other geometric or abstract patterns.

Referring once again to FIGS. 2 and 3, according to one preferred implementation, the fabric prebody is cut to form panels for the front 12 or back 14 of a thermal fabric garment 10, with high bulk regions 20 over the chest, rear torso and along the arms; low bulk regions 24 in the armpits, about the waist, in the middle back, and in bar regions over the shoulder blades; and intermediate bulk regions 22 along the lower arms and about the wrists, and about the front chest.

Also, as described above with reference to FIG. 1, and with reference now also to FIGS. 19-23, an engineered thermal fabric garment 10 is formed by joining together front fabric 12, rear fabric element 14 and sleeve or arm fabric elements 16, 18 by stitching at seams 18. In engineered thermal fabric garments including laminated fabric containing an air and liquid water impervious, breatheable film, e.g. a film that is hydrophilic non-porous or porous hydrophilic, it is desirable to seal the seam between fabric elements against penetration of water.

Figure 19:
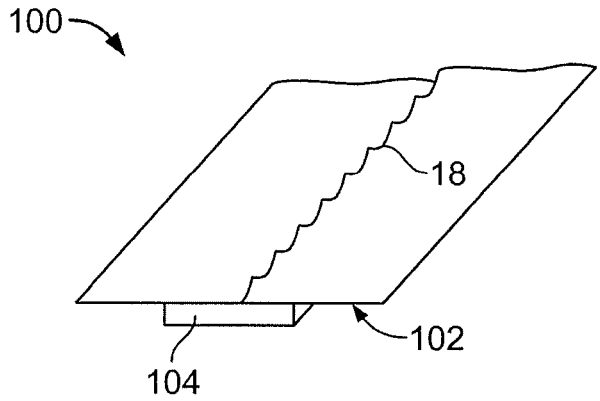
FIG. 19 is a somewhat diagrammatic side view of an engineered thermal fabric article in the region of a seam joining two engineered thermal fabric elements having flat (i.e., non-raised) inner side surfaces.

Referring to FIG. 19, in an engineered thermal fabric garment 100, where the inner side surface 102 is flat, i.e. not raised, the seam 18 can be sealed by applying a narrow band of thermoplastic film 104, typically polyurethane, over the seam, and then applying heat and pressure. The result is an effective seal with high resistance to liquid water, providing a garment suitable for use as waterproof rain gear.

Figure 20:
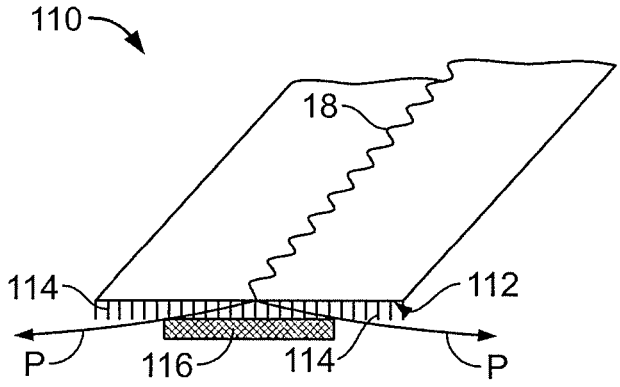
FIG. 20 is a similar, somewhat diagrammatic side view of an engineered thermal fabric article in the region of a seam joining two engineered thermal fabric elements having raised or fleece inner side surfaces.

In contrast, e.g., as demonstrated in FIG. 20, in an engineered thermal fabric garment 110 having an inner side surface 112 covered with fleece 114, or other raised surface material, even after taping, liquid water can penetrate the seam (arrows, P) and then flow through the fleece, around the tape 116.

Figure 21:
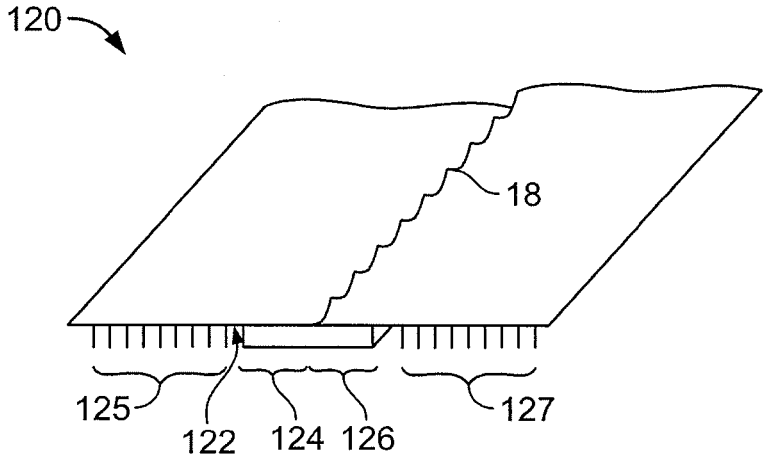
FIG. 21 is another, somewhat diagrammatic side view of an engineered thermal fabric article in the region of a seam joining two fabric elements having raised or fleece inner side surfaces with adjoining flat (i.e., non-raised) edge regions.
Figure 22:
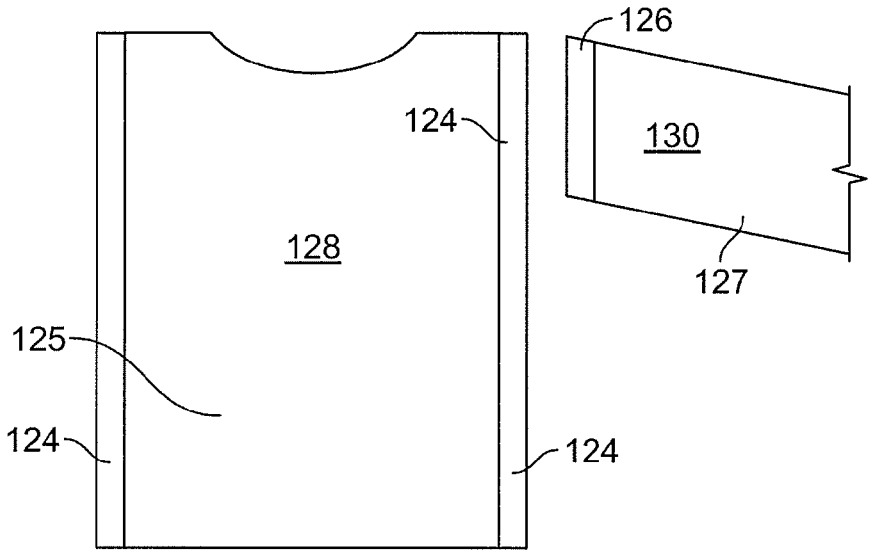
FIGS. 22 and 23 are somewhat diagrammatic front plan views of the process for assembling engineered thermal fabric elements of FIG. 21 is a manner to provide an engineered thermal fabric garment having a raised inner surface and suitable for use, e.g., as waterproof rain gear.
Figure 23:
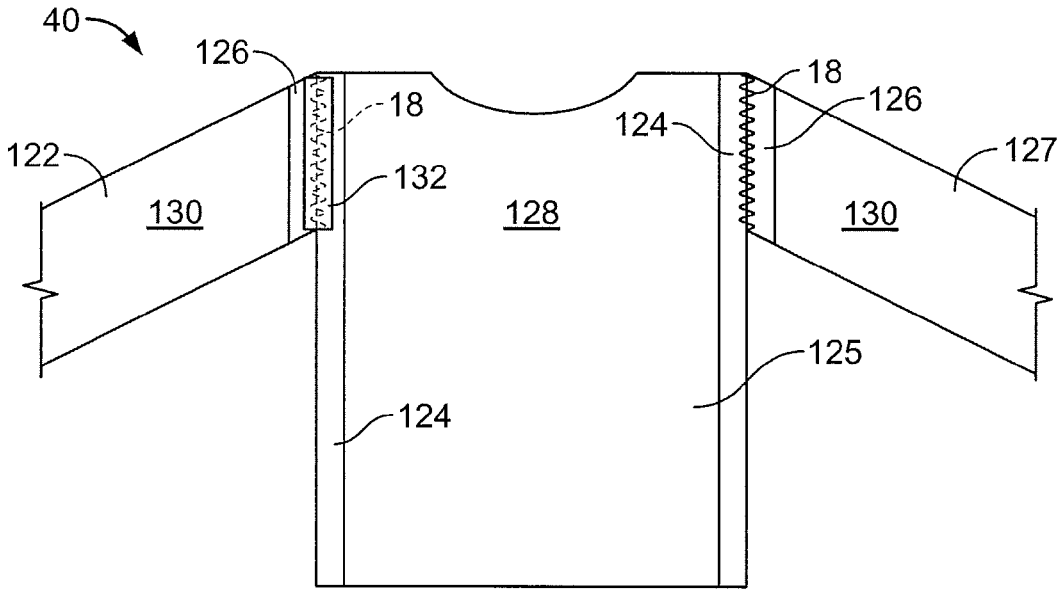

Referring now to FIG. 21, according to a further implementation, in an engineered thermal fabric garment 120, where the inner side surface 122 is raised, no loop regions 124, 126 are created (e.g. employing a jacquard machine or the like) in the seam areas (i.e., along the outlines of the fabric segments to be cut and sewn), while the regions 125, 127 inwardly from the seam 18 are raised and finished as velour, shearling, or other. Referring also to FIGS. 22 and 23, the fabric elements, e.g. a front fabric element 128 and arm or sleeve fabric elements 130, turned inside out for the joining process, are then joined along the seam 18, and the seam is sealed by applying a narrow band of thermoplastic (e.g. polyurethane) tape 132 over the seam 18 in the flat, no loop regions 124, 126 between the raised regions 125, 127, and then applying heat and pressure. The result is an effective seal with high liquid water resistance, providing a garment 140 having a raised inner surface 122 and suitable for use as waterproof rain gear.

Figure 24:
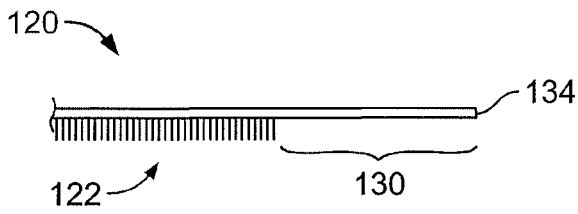
FIGS. 24 and 24A, FIGS. 25 and 25A, and FIGS. 26 and 26A are other, somewhat diagrammatic side views of an engineered thermal fabric articles with raised or fleece regions of inner side surfaces and adjoining flat (i.e., non-raised) regions adjacent the fabric edge (FIGS. 24, 24A and FIGS. 25, 25A) or spaced from the fabric edge (FIGS. 26, 26A).
Figure 24A:
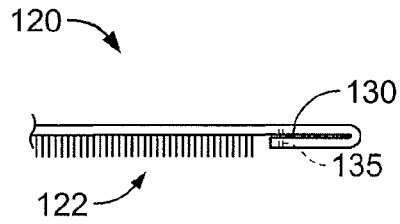
Figure 25:
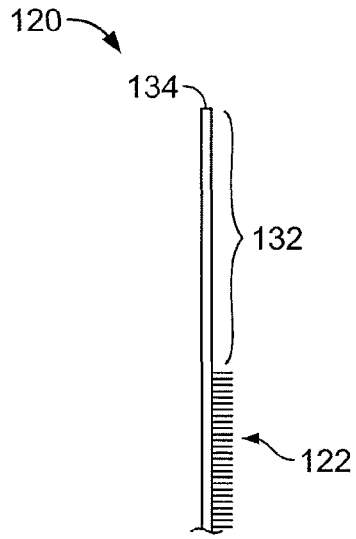
Figure 25A:
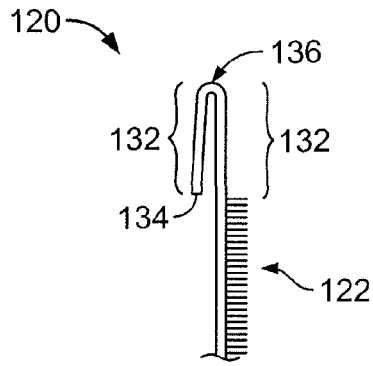

Similarly, referring to FIGS. 24 and 24A and to FIGS. 25 and 25A, in still other implementations, the engineered thermal fabric garment 120 having a raised inner side surface 122 of a single face unitary fabric element or unitary fabric laminate may have other no-loop or low loop regions 130, 132 created in other areas. For example, in FIG. 24, no-loop or low loop region 130 is created adjacent to and along fabric edge 134, e.g. at the bottom edge of the garment, while adjacent region 131 inwardly from the edge 134 is raised and finished as velour, shearling, or other. Referring next to FIG. 24A, the no-loop or low loop region 130 of the fabric garment is then folded back upon itself, and perhaps secured at the edge, e.g. by stitching 134, without creating excessive or unnecessary extra bulk in the folded region, e.g. as compared to the effect of doubling of the raised body region 131 of the fabric garment. Referring now to FIG. 25, in another example, no-loop or low loop region 132 is created at a predetermined region 136 of a fold, such as at the collar or sleeves, in the engineered thermal fabric garment 120, while adjacent region 131 inwardly from the edge 134 is raised and finished as velour, shearling, or other. Referring next to FIG. 25A, the no-loop or low-loop region 132 of the fabric garment is then folded, without creating excessive or unnecessary extra bulk in the folded region, as compared to doubling of the body of the fabric garment.

Figure 26:
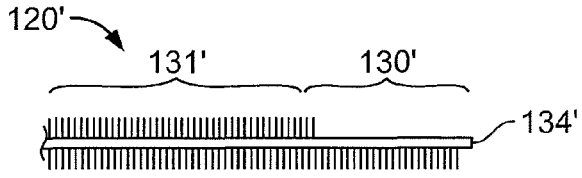
Figure 26A:
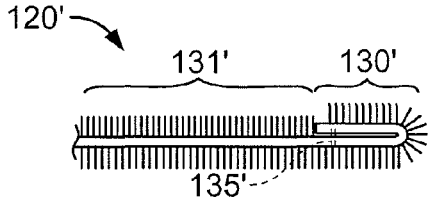

Referring to FIGS. 26 and 26A, in another implementation, the engineered thermal fabric garment 120' having a raised inner side surface and a raised outer side surface of a laminate or a double face fabric may have other no-loop or low loop regions 130' created in other areas. For example, in FIG. 26, no-loop or low loop region 130' is created adjacent to and along fabric edge 134', e.g. at the bottom edge of the garment, while adjacent region 131' inwardly from the edge 134' is raised and finished as velour, shearling, or other. Referring next to FIG. 26A, the no-loop or low loop region 130' of the fabric garment is then folded back upon itself, and perhaps secured at the edge, e.g. by stitching 135', without creating excessive or unnecessary extra bulk in the folded region, e.g. as compared to the effect of doubling of the raised body region 131' of the fabric garment.

Further description is provided by the following examples, which do not limit the scope of the claims.

EXAMPLES

Example 1

In an engineered thermal fabric garment, the height of the higher sinker loop pile is about 2.0 mm to 5.0 mm, e.g. the higher loop pile height is typically about 3.5 mm and can be about 5 mm to 6 mm after raising, and the low sinker loop pile is about 0.5 mm to 1.5 mm. Regions with relatively high loop pile generate significantly higher bulk than regions with relatively low loop pile and, as a result, provide higher insulation levels. Regions with no loop pile do not generate any bulk, and subsequently can have very high breatheability to enhance cooling during high activity, e.g., cooling by heat of evaporation.

Example 2

In another engineered thermal fabric article, one sinker loop pile yarn is employed with a variety of no loop pile in predetermined patterns and contrasting density to create a large region of no loop pile, e.g., in the neck and armpit areas, for minimum insulation; a region of mixed pile and no loop pile in the abdominal area, for medium insulation; and a region of 100% loop pile in the chest area, for maximum insulation.

Example 3

In still another engineered thermal fabric garment, high loop pile height with inherent wind breaking (maximum tortuosity) construction is provided in the chest area with high loop pile, the arm pit areas have no loop pile, and regions adjacent to the arm pit areas are provided with relatively lower loop pile height that still provides an enhanced degree of inherent wind breaking and some lesser degree of insulation, e.g., as compared to the higher pile height regions.

Example 4

In yet another engineered thermal fabric garment, the body of the fabric has high loop pile in an open knit construction, with a section, e.g., in the armpit areas, of very low pile with a region of no loops. This fabric is laminated to a knit construction with velour of at least one pile height, e.g., low, high and/or any combination thereof, and a breatheable membrane (porous hydrophobic or non porous hydrophilic) in between. The segment of no loops and/or low loops has significantly higher MVT (resulting in less resistance to moisture movement).

Example 5

In still another engineered thermal fabric garment, the body of the fabric is formed by the combination of high loop pile, low loop pile and no loop pile. Regions of the high loop pile that are raised (by napping) or have cut loops generate high levels of insulation in static (at rest) conditions. The low loop pile regions and/or no loop pile regions provide good breatheability and cooling effect in dynamic conditions, e.g. while running.

Example 6

In yet another engineered thermal fabric garment, multiple layers of engineered fabric (e.g. first layer, mid layer and outer layer) are combined. In one preferred implementation, the pile height patterns of the layers are the same to create an additive effect. In another implementation, the pile height patterns of varied between layers to develop a synergy between the different layers. In each of these implementations, the technical face 36 (jersey) can be raised by napping, sanding, or brushing to generate velour.

Example 7

Figure 27:
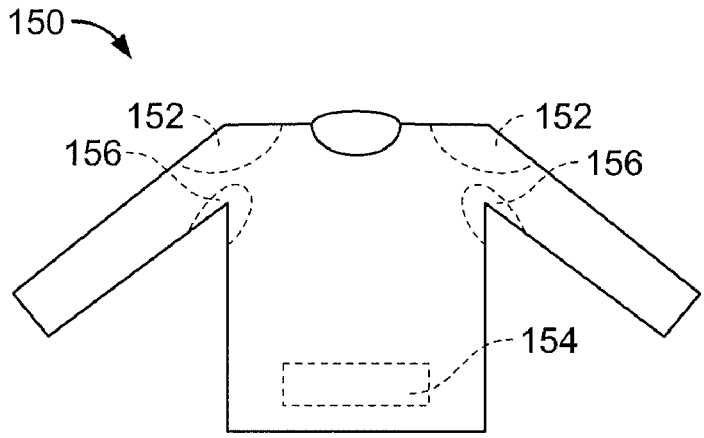
FIG. 27 is a front plan view of another implementation of an engineered thermal fabric garment.

Referring to FIG. 27, an engineered thermal fabric garment 150, designed in particular to be worn beneath body armor, e.g. by law enforcement and military personnel, has regions of relatively higher or thicker pile at the shoulders 152 and under the belly 154 for providing cushioning beneath the body armor and enhancing comfort to the wearer. Relatively lower or thinner pile, or no pile, regions, with relatively higher breatheability and higher CFM (i.e., cubic feet per minute (or CMM (cubic meter per minute)) air flow) are provided under the arms, in the armpit areas 156. The fabric garment is formed with spandex incorporated into the stitch yarn for improved stretch and comfort.

In versions of the engineered thermal fiber garment for use in warm weather conditions, relatively larger regions of no loop/no pile in plaited construction are provided under the body armor.

In versions for use in cold weather conditions, relatively large regions of laminate constructed for controlled air permeability with low CFM (or CMM) (e.g., by providing an intermediate layer in the form of a perforated membrane, a crushed adhesive layer, a foam adhesive layer, or a discontinuous breatheable membrane, as described above, for controlled low air permeability with relatively high insulation), and regions of relatively higher CFM (or CMM) and relatively less insulation (less bulk) under the body armor.

Example 8

Figure 28:
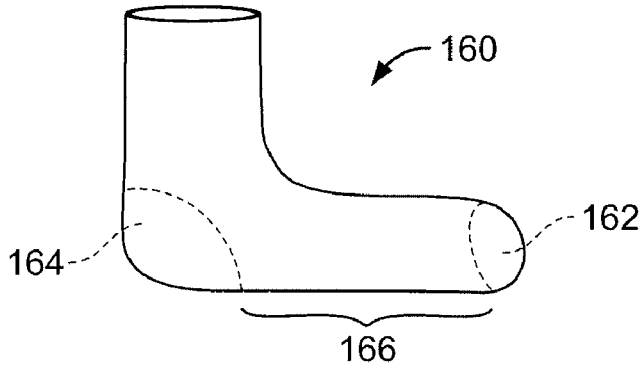
FIG. 28 is a front plan view of still another implementation of an engineered thermal fabric garment, here, a sock.

Referring to FIG. 28, an engineered fabric article in the form of a sock 160 has predetermined regions of different levels of enhanced cushioning. The fabric is finished in open width by raising the fabric on one surface or both surfaces, or by cutting high loops or leaving the surface as is, in loop form. The loops may be formed with high loop height in regions designed for high cushioning, and with low loop height in other regions designed for medium cushioning, and with no loop height in still other regions for very low cushioning. The fabric may typically be formed with spandex to further enhance fit of the socks.

By way of example only, in the sock 160 seen in FIG. 28, the toe region 162 is provided with high cushioning, the heel region 164 is provided with medium cushioning, and the arch region 166 is provided with very low or no cushioning. The arrangement of cushioning regions, and the level of cushioning provided, may be modified or adjusted in accordance with planned end use, like walking, running and other athletic endeavors, such as basketball.

Example 9

Figure 29:
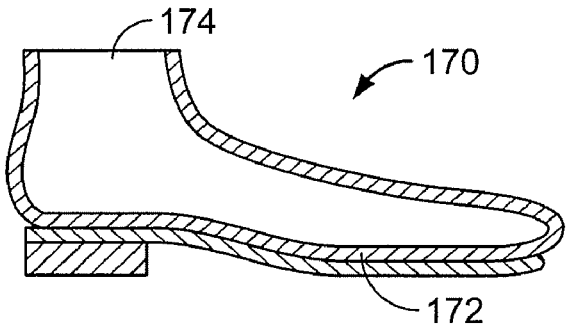
FIG. 29 is a side section view of yet other implementations of engineered thermal fabric garments, here, for footwear.

Referring next to FIG. 29 other engineered fabric garments are formed for use in footwear 170, e.g., as an insole or insert 172, or as a shoe lining 174, again with different levels or degrees of cushioning in different predetermined regions.

Example 10

Figure 30:
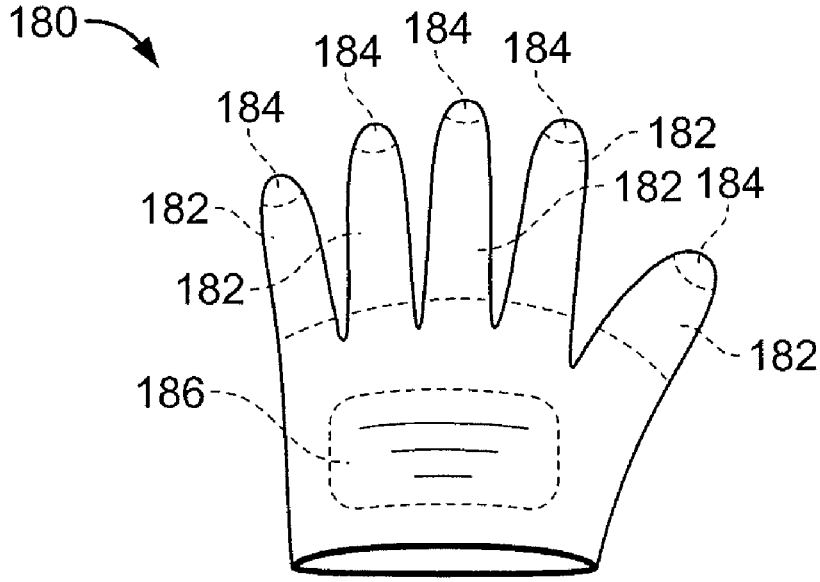
FIGS. 30 and 31 are front and rear plan views, respectively, of another implementation of an engineered thermal fabric garment, here, a glove.
Figure 31:
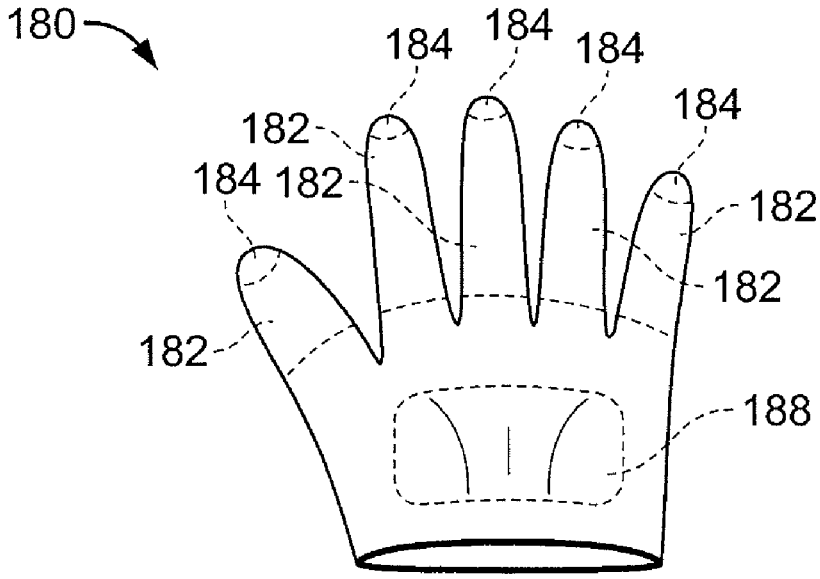

Referring now to FIGS. 30 and 31, an engineered fabric garment is constructed in the form of a glove 180 with predetermined regions having different levels of cushioning and/or different levels of insulation, e.g. for use as a winter glove in cold weather, by providing different regions engineered with controlled levels of pile height. The level of cushioning may be controlled as a function of loop height, the numbers of fibers and/or yarns per cross-sectional area, and/or the physical properties of the yarns, e.g. tenacity, compression, modulus, etc.

For example, along the lengths of the fingers, regions 182 of high insulation and cushioning may be provided (perhaps with relatively less pile or cushioning in regions 184 at the tips or extremities of the fingers (and thumb), as compared to the regions 182 along the lengths of the fingers (and thumb), for improved dexterity). There may also be different pile heights in the palm region 186 of the glove on the front side and/or on the rear surface region 188 of the hand. In other implementations, e.g. for work gloves, relatively more cushioning made be provided in the region 186 of the face surface of the palm, with less bulk or no bulk, and relatively less cushioning, in the regions 182, 184 of the fingers (and the thumb).

Example 11

Figure 32:
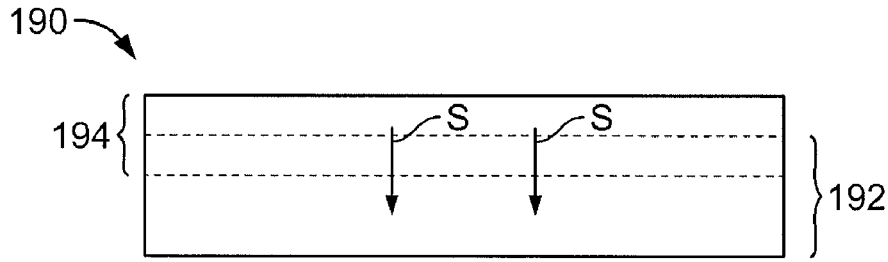

Referring next to FIG. 32, another implementation of an engineered fabric garment is formed with a plaited construction in which two layers are knit simultaneously, with the layers being separate but integrally intertwined. The plaited knit construction 190 is formed in a single jersey knit or a double knit, with a synthetic yarn having fine dpf being employed to form the outer side layer 192 of the garment fabric layer and yarn with relatively coarser dpf being employed to form the inner side layer 194, thereby to promote better water management and user comfort, i.e., by moving liquid sweat (arrows, S) from the inner layer to the outer layer, from where it will evaporate to the ambient environment.

Figure 33:
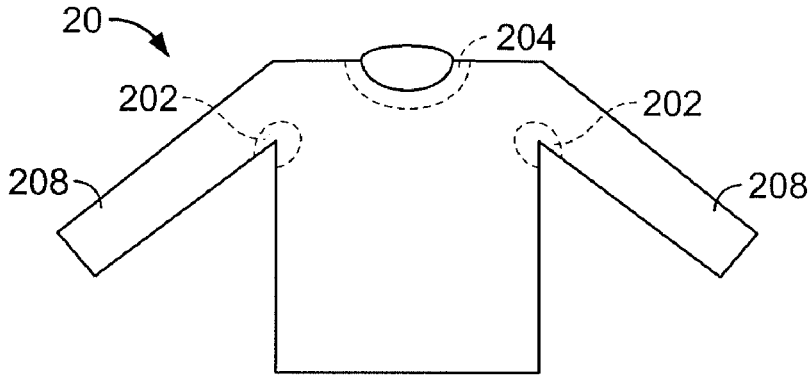
FIGS. 33 and 34 are front and rear plan views, respectively, of another implementation of an engineered thermal fabric garment, e.g. formed with engineered thermal fabric shown in FIG. 32.
Figure 34:
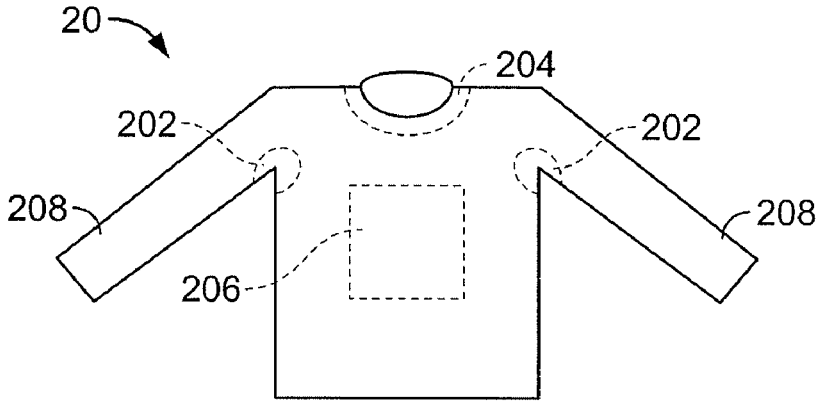

Referring now to FIGS. 32 and 33, in a further enhancement, fabric garment 200 is constructed with engineered patterns of predetermined regions in the first (inner) fabric layer. For example, some regions, such as the armpit areas 202, the neck area 204 and center back area 206, have open mesh ("see-through") construction, formed by electronic transfer knitting, while other regions, e.g. arm areas 208, have a smooth face, formed by full knit construction, for better aerodynamic performance. Still other regions are provided with a textured appearance, formed, e.g., by knit-tuck or knit-welt or knit-welt-tuck, in order to achieve better water (i.e. liquid sweat) management in the front chest area 210 and/or the lower back region 212. The inner surface of the fabric garment is brushed just slightly in order to reduce the number of touching points to the skin and thus minimize the clinging effect, i.e. of fabric sticking to wet, sweaty skin.

Referring again to FIG. 32, the engineered first layer 194 of the garment 190, i.e. the inner surface, next to the skin is further enhanced. For example, the layer may include synthetic fibers, like polyester, treated chemically to render the fibers hydrophilic. Also, spandex may be added to the plaited knit construction to achieve better stretch recovery properties, as well as obtaining two-way stretch, i.e., lengthwise and widthwise. For example, in one implementation, a triple plaited jersey construction is employed, with spandex yarn plaited between an inner layer of coarse fibers of synthetic material treated chemically to render the fibers hydrophilic and an outer layer of natural fibers, such as wool or cotton. The knit fabric may also be formed with double knit or double plaited jersey construction.

The second (outer) layer 192 of the fabric garment 190 may be provided with anti-microbial properties, e.g. for minimizing undesirable body odors caused by heavy sweating due to high exertion, by applying anti-microbial chemicals to the surface 196 of the fabric 190 or by forming the second (outer) fabric layer 192 with yarn having silver ions embedded in the fibers during the fiber/yarn extrusion process or applied to the surface of the fibers (e.g., as described in U.S. Pat. No. 6,194,332 and U.S. Pat. No. 6,602,811). Yarn employed in forming the first (inner) fabric layer 194 may include fibers containing ceramic particles, e.g. Z,C (Zirconium Carbide) in order to enhance body heat reflection from the skin, and to provide better thermal insulation (e.g. as described in the U.S. patent application Ser. No. 09/624,660, filed Jul. 25, 2000).

Example 12

Engineered thermal fabric garments may be formed using a suitable knitting system for providing two and/or three contrasting pile heights in one integrated knit construction, which can be finished as single face or double face.

For example, in a first system, sinker loops of contrasting pile height may be generated at different, predetermined regions with high loop (about 3.5 mm loop height and 5 to 6 mm after raising), low loop and no loop. In second system, the loop yarn may be cut on the knitting machine, forming regions of high pile height (up to about 20 mm) and no pile. In each system, using circular knitting, a single type of yarn may be employed, or yarns of different characteristics, e.g. contrasting shrinkage, luster, cross section, count, etc., may be employed in different regions.

In the case of loops yarn, e.g. as in the first system, the loops may be left as is (without raising), or the highest loops may be cut (leaving the low loop and no loop as is), or both loops may be napped, in which case both loops will generate velour after shearing at the same pile height, and only after tumbling will pile differentiation be apparent, with generation of shearling in the high loop and small pebble in the low loop.

In the case of contrasting yarns, as in the second system, differentiation in pile height between different regions will be based on the individual yarn characteristics, which will become apparent after exposure to thermal conditions.

Maximum knitting capability for creation of the discrete regions of contrasting characteristics may be provided by use of electronic sinker loop selection, which will generate different loop heights in the knit construction, and electronic needle selection, which will generate different knit constructions of the stitch yarn, such as 100% knit, knit-tuck, knit-welt and knit-tuck-welt, with different aesthetics and contrasting air permeability performance in predetermined regions, with our without sinker loops.

Example 13

An engineered thermal fabric is formed as described above with a pattern of one or more regions having a first pile height and one or more regions having no pile. The one or more regions of first pile height are formed with two different yarns of significantly different shrinkage performance. For example, the yarn having relatively high shrinkage is made of very fine micro fibers, e.g. 2/70/200 tx, and the yarn having relatively less or no shrinkage is made relatively more coarse and longer fibers, e.g. 212/94 polyester yarn with ribbon shape. When exposed to heat, the fabric forms a textured surface without pattern, resembling animal hair, with long, coarse fibers (like guard hairs) extending upwards from among the short, fine fibers at the surface. This is almost a "pick and pick" construction, or can be termed "stitch and stitch" for knit construction.

Example 14

In yet another implementation of an engineered thermal fabric article with regions of contrasting insulative capacity and performance arranged by body mapping concepts, an engineered thermal blanket may be tailored to the insulative requirements of different regions of the projected user's body, thus to optimize the comfort level of the person while sleeping. In most cases, the regions of a person's lower legs and feet and a person's arms and shoulders tend to be relatively more susceptible to cold and thus will require a relatively higher level of insulation, e.g. relatively higher pile height and/or higher fiber density, for comfort and sleep, while, in contrast, the region of a person's upper torso and regions of the person's hips and head, especially from the sides, tend to require relatively less insulation.

Referring now to FIG. 35, an engineered thermal blanket 300 is shown spread for use on a bed. The blanket may be formed of single face raised fabric or double face raised fabric, and the fabric may be warp knit, circular knit or woven. The region 302 of the person's lower legs and feet and the regions 304, 306 of the person's arms and shoulders have relatively higher pile height and/or relatively higher fiber density. In contrast, the region 308 of the person's upper torso and the regions 310, 312 and the regions 314, 316 adjacent to the person's head and hips, respectively, have relatively low pile or no pile, e.g. depending in personal preference, seasonal conditions, etc. The region 318 below the feet has no pile or low pile, as it is typically tucked beneath the mattress. The fabric of the blanket has a three dimensional geometry, where the thickness of the surfaces of the insulative regions of the head, arms and shoulders, and lower torso, legs and feet are typically in velour, loop, terry in raised surface or sheared/cut loop or as formed.

Example 15

In another implementation of an engineered thermal blanket, which is simplified for purposes of manufacture, the regions of contrasting insulative capacity and performance are arranged in band form, extending across the blanket. For example, referring to FIG. 36, an engineered thermal blanket 350 is shown spread for use on a bed. A lower band region 352 having relatively higher pile height and/or relatively higher fiber density is positioned to extend generally across the person's lower torso, legs and feet and an upper band region 354 also of relatively higher pile height and/or relatively higher fiber density is positioned to extend generally across the person's arms and shoulders. At the upper and lower extremities, respectively, of the blanket 350, an upper band region 356 of relatively low pile or no pile is positioned to extend generally across the person's head and a lower band region 358 of relatively low pile or no pile is positioned to be folded beneath the blanket. In between region 352 and 354, an intermediate region 360, also of relatively low pile or no pile, is positioned to extend generally across the person's upper torso.

As described above, the surfaces of the region 354 of the head, arms and shoulders, and the region 352 of the lower torso, legs and feet are plain velour, while the upper band region 356 and intermediate region 360 are low pile. Typically, the yarn and the pile density are maintained constant for all regions, again for simplicity of manufacture. The vertical widths of the respective regions represented in the drawing are by way of example only. Regions of any dimension can be arranged, tailored, e.g., for use by persons of different ages and different genders, etc. and for other factors, such as seasonality, etc.

Example 16

Figure 37:
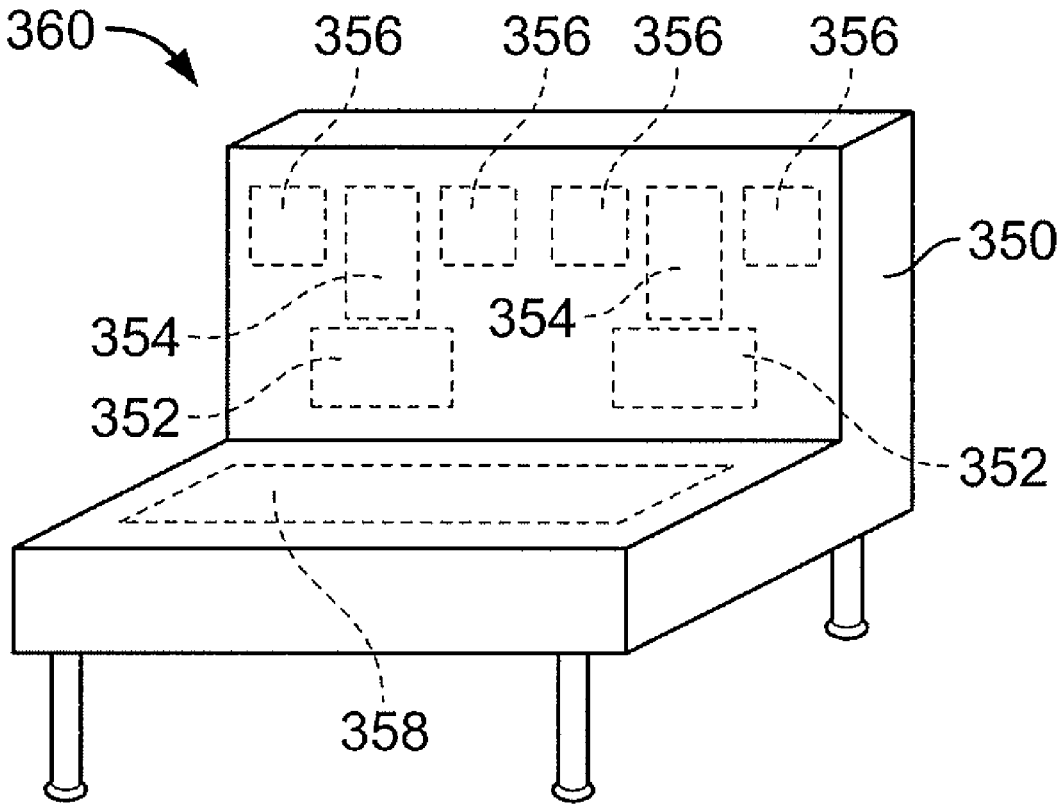
FIG. 37 is a somewhat diagrammatic view of an engineered thermal fabric article in the form of an upholstery cover, here, on a vehicle seat, e.g. a two person bench seat on a train.

Referring to FIG. 37, an engineered thermal fabric upholstery cover 350 is shown installed on a two-person bench seat 360, e.g. on a commuter train. The upholstery cover, formed according to the methods described above, has regions 352, 354, corresponding to a user's lower back and mid-back regions, respectively, and regions 356, 358, corresponding to a user's shoulder blade and buttocks regions, respectively. The regions 352, 254 are engineered for relatively greater breatheability and relatively less sweat inducement for the user. The regions 356, 358 may be engineered with relatively greater cushioning and relatively greater comfort for the rider.

Other engineered thermal fabric garments, home textile articles, such as mattress cover, mattress ticking, viscoelastic mattress ticking, etc., and upholstery covers can be formed with similar application of the described concepts for arranging regions of contrasting insulative capacity in positions having corresponding insulative requirements of a user's body. The arrangements and insulative capacities can be varied with the precise nature and use of the particular garment, home textile article, or upholstery cover, and/or with one or more other factors, e.g. with gender, age, size, season, etc.

Also, the engineered thermal fabric regions can have pile of any desired fiber density and any desired pile height, with the contrast of insulative capacity and performance achieved, e.g., by different pile heights (e.g., using different sinker heights), different pile densities (e.g., using full face velour and velour with pattern of low pile or no pile), and different types of yarns (e.g., using flat yarns with low shrinkage and texture yarns with high shrinkage). Engineered thermal fabric regions of contrasting high pile, low pile, and/or no pile may be generated, e.g., by electronic sinker selection or by resist printing, as described below, and as described in U.S. Provisional Patent Application No. 60/674,535, filed Apr. 25, 2005. For example, sinker loops of predetermined regions may be printed with binder material in an engineered body mapping pattern, e.g., to locally resist raising. The surface is then raised in non-coated regions. The result is a fabric having an engineered pattern of raised regions and non-raised regions. The printed regions may be formed of sub-regions of contrasting thermal insulation and breatheability performance characteristics by use of different binder materials, densities of application, penetration, etc., thereby to achieve optimum performance requirements for each sub-region of the engineered printing pattern. Other aesthetic effects may also be applied to the face side and/or to the back side of the engineered thermal fabric, including, e.g., color differentiation and/or patterning on one or both surfaces, including three dimensional effects. Selected regions may be printed, and other regions may be left untreated to be raised while printed regions remain flat, resisting the napping process, for predetermined thermal insulation and/or breatheability performance effects. Also, application of binder material in a predetermined engineered pattern may be synchronized with the regular wet printing process, including in other regions of the fabric body. The wet printing may be applied to fabric articles made, e.g., with electronic sinker loop selection or cut loop (of the pile) of cut loop on the knitting machine and may utilize multiple colors for further aesthetic enhancement. The colors in the wet print may be integrated with the resist print to obtain a three-dimensional print on one or more regions of the fabric, or even over the entire fabric surface. The sizes, shapes and relationships of the respective regions represented in the drawing are by way of example only. Regions of any shape and size can be arranged in any desired pattern, tailored, e.g., for use by persons of different ages and different genders, etc. and for other factors, such as seasonality, etc.

Other Implementations

A number of implementations have been described. Nevertheless, it will be understood that various modifications and rearrangements may be made without departing from the spirit and scope of this disclosure. For example, any suitable type of yarn or yarn material may be employed. Also, as described above, engineered fabrics may be used advantageously in numerous other applications beyond those described above.

Also as described above, engineered fabrics may be used advantageously in military applications, e.g., in garments worn under protective body armor. Engineered fabrics may also be used advantageously for first layer garments, i.e. long and short underwear, in particular for applications where effective movement of liquid sweat from the garment inner surface (against the wearer's skin) to the garment outer surface is a concern for reasons of improved wearer comfort. In these applications, the fabric may be formed with plaited construction, e.g. plaited jersey or double knit construction, e.g. as described in U.S. Pat. Nos. 6,194,322 and 5,312,667, with a denier gradient, i.e. relatively finer dpf on the outer surface of the fabric and relatively more coarse dpf on the inner surface of the fabric, for better management of water (liquid sweat). In preferred implementations, one or more regions will be formed with full mesh, i.e. see through holes, for maximum ventilation, and contrasting regions of full face plaited yarn for movement of moisture, with intermediate regions in other areas of the garment having relatively lesser concentrations of mesh openings, the regions positioned to correlate with ventilation requirements of the wearer's underlying body.

Multiple layers of engineered thermal fabric garments, e.g. underwear (first layer), insulation layer (mid layer), and outerwear (protection layer) may be worn in combination, with the engineered fabrics working together in synergy for comfort of the wearer.

Accordingly, other implementations of the disclosure are within the scope of the following claims.

What is claimed is:

1. A method of forming a unitary fabric element for use in an engineered thermal fabric article having a multiplicity of predetermined discrete regions of contrasting insulative capacity positioned about the article in an arrangement having correlation to insulative requirements of corresponding regions of a user's body, the unitary fabric element defining at least two predetermined, discrete regions of contrasting insulative capacity, said method comprising the steps of:

designing a pattern of the predetermined, discrete regions;

combining yarn and/or fibers in a continuous web according to the pattern of predetermined, discrete regions, comprising the steps of, in one or more first discrete regions of the fabric element, forming loop yarn to a first pile height, the one or more first discrete regions corresponding to one or more regions of the user's body having first insulative requirements, and in one or more other discrete regions of said fabric element, forming loop yarn to another pile height different from and relatively greater than the first pile height, the one or more other discrete regions corresponding to one or more regions of the user's body having other insulative requirements different from and relatively greater than the first insulative requirements;

finishing one or both surfaces of the continuous web to form the predetermined, discrete regions into discrete regions of contrasting pile heights; and removing the unitary fabric element from the continuous web according to the pattern of predetermined, discrete regions.

2. The method of forming a unitary fabric element for use in an engineered thermal fabric article of claim 1, wherein the designing of a pattern of the predetermined, discrete regions comprises designing of the pattern for use in an engineered thermal fabric garment.

3. The method of forming a unitary fabric element for use in an engineered thermal fabric article of claim 1, wherein the unitary fabric element comprises a silhouette for an engineered thermal fabric garment and the method comprises the further steps of:

forming a complementary unitary fabric element with a complementary pattern of predetermined, discrete regions, the complementary unitary fabric element comprising a complementary silhouette for the engineered fabric element; and joining together the unitary fabric element and the complementary unitary fabric element to form the engineered thermal fabric garment.

4. The method of forming a unitary fabric element for use in an engineered thermal fabric article of claim 1, wherein the designing of a pattern of the predetermined, discrete regions comprises designing of the pattern for use in an engineered thermal fabric home textile article.

5. The method of forming a unitary fabric element for use in an engineered thermal fabric article of claim 4, wherein the designing of a pattern of the predetermined, discrete regions comprises designing of the pattern for use in an engineered thermal fabric home textile article in the form of a blanket.

6. The method of forming a unitary fabric element for use in an engineered thermal fabric article of claim 4, wherein the designing of a pattern of the predetermined, discrete regions comprises designing of the pattern for use in an engineered thermal fabric home textile article in the form of an article selected from the group consisting of: mattress cover, mattress ticking, and viscoelastic mattress ticking.

7. The method of forming a unitary fabric element for use in an engineered thermal fabric article of claim 1, wherein the designing of a pattern of the predetermined, discrete regions comprises designing of the pattern for use in an engineered thermal fabric upholstery cover.

8. The method of forming a unitary fabric element for use in an engineered thermal fabric article of claim 1, wherein the combining yarn and/or fibers in a continuous web according to the pattern of the predetermined, discrete regions comprises combining yarn and/or fibers by use of electronic needle and/or sinker selection.

9. The method of forming a unitary fabric element for use in an engineered thermal fabric article of claim 1, wherein the forming loop yarn to a first pile height and to another pile height comprises forming loops at a technical back of the unitary fabric element.

10. The method of forming a unitary fabric element for use in an engineered thermal fabric article of claim 1, wherein the combining yarn and/or fibers in a continuous web comprises combining yarn and/or fibers by tubular circular knitting.

11. The method of forming a unitary fabric element for use in an engineered thermal fabric article of claim 10, wherein the combining yarn and/or fibers in a continuous web by tubular circular knitting comprises combining yarn and/or fibers by reverse plaiting.

12. The method of forming a unitary fabric element for use in an engineered thermal fabric article of claim 11, wherein the finishing comprises finishing one surface of the continuous web to form a single face fleece.

13. The method of forming a unitary fabric element for use in an engineered thermal fabric article of claim 11, wherein the finishing comprises finishing both surfaces of the continuous web to form a double face fleece.

14. The method of forming a unitary fabric element for use in an engineered thermal fabric article of claim 10, wherein the combining yarn and/or fibers in a continuous web by tubular circular knitting comprises combining yarn and/or fibers by plaiting.

15. The method of forming a unitary fabric element for use in an engineered thermal fabric article of claim 14, comprising the steps of combining the yarn and/or fibers by regular plaiting and finishing one surface of the continuous web to form a single face fleece.

16. The method of forming a unitary fabric article for use in an engineered thermal fabric article of claim 14, comprising combining the yarn and/or fibers by reverse plaiting and finishing both surfaces of the continuous web to form a double face fleece.

17. The method of forming a unitary fabric element for use in an engineered thermal fabric article of claim 1, wherein the combining yarn and/or fibers in a continuous web comprises combining yarn and/or fibers by warp knitting.

18. The method of forming a unitary fabric element for use in an engineered thermal fabric article of claim 1, wherein the combining yarn and/or fibers in a continuous web comprises combining yarn and/or fibers to form a woven fabric element.

19. The method of forming a unitary fabric element for use in an engineered thermal fabric article of claim 1, wherein the combining yarn and/or fibers in a continuous web comprises combining yarn and/or fibers to form a fully fashion knit fabric body.

20. The method of forming a unitary fabric element for use in an engineered thermal fabric article of claim 1, wherein the finishing one or both surfaces of the continuous web to form the predetermined, discrete regions into discrete regions of contrasting pile heights comprises raising one surface or both surfaces.

21. The method of forming a unitary fabric element for use in an engineered thermal fabric article of claim 1, comprising the further step of incorporating the unitary fabric element in a unitary fabric laminate.

22. The method of forming a unitary fabric element for use in an engineered thermal fabric article of claim 21, wherein the incorporating the unitary fabric element in a unitary fabric laminate comprises the step of laminating the unitary fabric element with a controlled air permeability element.

23. The method of forming a unitary fabric element for use in an engineered thermal fabric article of claim 1, wherein the forming loop yarn to the first pile height comprises forming loop yarn to a low pile using low sinker and/or shrinkable yarn.

24. The method of forming a unitary fabric element for use in an engineered thermal fabric article of claim 1, wherein the forming loop yarn to the first pile height comprises forming loop yarn with no pile.

25. The method of forming a unitary fabric element for use in an engineered thermal fabric article of claim 1, wherein the forming loop yarn to the first pile height comprises forming loop yarn to a low pile height using a combination of low pile using low sinker and/or shrinkable yarn and no pile.

26. The method of forming a unitary fabric element for use in an engineered thermal fabric article of claim 1, wherein the forming loop yarn to the first pile height comprises forming loop yarn to a low pile height of about 1 mm.

27. The method of forming a unitary fabric element for use in an engineered thermal fabric article of claim 1, wherein the forming loop yarn to the another pile height different from and relatively greater than the first pile height, comprises forming loop yarn to a high pile height in the range of greater than about 1 mm up to about 20 mm.

28. The method of forming a unitary fabric element for use in an engineered thermal fabric article of claim 1, wherein the multiplicity of predetermined discrete regions of contrasting insulative capacity positioned about the article in an arrangement having correlation to insulative requirements of corresponding regions of a user's body comprises discrete regions selected from the group consisting of: high pile, low pile, no pile and combinations thereof.

29. The method of forming a unitary fabric element for use in an engineered thermal fabric article of claim 1, wherein the multiplicity of predetermined discrete regions of contrasting insulative capacity positioned about the article in an arrangement having correlation to insulative requirements of corresponding regions of a user's body comprises discrete regions selected from the group consisting of: high sinker loop, low sinker loop, no pile and combinations thereof.

30. The method of forming a unitary fabric element for use in an engineered thermal fabric garment of claim 3 wherein the one or more first discrete regions and the one or more other discrete regions correspond to one or more regions of the wearer's body selected from the group consisting of: spinal cord area, spine, back area, upper back area, lower back area, neck area, back of knee areas, front of chest area, breast area, abdominal area, armpit areas, arm areas, front of elbow areas, sacrum dimple areas, groin area, thigh areas, and shin areas.

* * * * *